US007727603B2

(12) United States Patent
Kobayashi et al.

(10) Patent No.: US 7,727,603 B2
(45) Date of Patent: Jun. 1, 2010

(54) TRANSFER MEMBER OF IMAGE FORMING MATERIAL FOR ELECTROPHOTOGRAPHY AND MEMBER HAVING IMAGE RECORDED THEREON USING THE SAME

(75) Inventors: Tomoo Kobayashi, Minamiashigara (JP); Kunio Sakurai, Ashigarakami-gun (JP); Kaoru Torikoshi, Minamiashigara (JP); Tetsuro Kodera, Ashigarakami-gun (JP); Naoyuki Egusa, Ashigarakami-gun (JP)

(73) Assignee: Fuji Xerox Co., Ltd., Tokyo (JP)

( * ) Notice: Subject to any disclaimer, the term of this patent is extended or adjusted under 35 U.S.C. 154(b) by 139 days.

(21) Appl. No.: 10/929,537

(22) Filed: Aug. 31, 2004

(65) Prior Publication Data

US 2005/0175819 A1 Aug. 11, 2005

(30) Foreign Application Priority Data

Feb. 10, 2004 (JP) ..... 2004-033946

(51) Int. Cl.
*B41M 5/40* (2006.01)

(52) U.S. Cl. ..... 428/32.39; 428/206; 428/480; 428/913.3; 428/914

(58) Field of Classification Search ..... 428/32.39, 428/480, 914, 206, 913.3
See application file for complete search history.

(56) References Cited

U.S. PATENT DOCUMENTS 5,756,188 A * 5/1998 Reiter et al. ..... 428/195.1
6,072,976 A * 6/2000 Kuriyama et al. ..... 399/302
2002/0182520 A1* 12/2002 Torikoshi ..... 430/18
2004/0126690 A1* 7/2004 Kobayashi et al. ..... 430/97

FOREIGN PATENT DOCUMENTS

| | | |
|---|---|---|
| EP | 1 033 706 A1 | 9/2000 |
| JP | A 5-96871 | 4/1993 |
| JP | A 7-68812 | 3/1995 |
| JP | A 8-142365 | 6/1996 |
| JP | A 8-156302 | 6/1996 |
| JP | A 9-314875 | 12/1997 |
| JP | A 11-291646 | 10/1999 |
| JP | A 11-334265 | 12/1999 |
| JP | A 2001-92255 | 4/2001 |
| JP | A-2002-293095 | 10/2002 |
| JP | A-2003-91090 | 3/2003 |

OTHER PUBLICATIONS

Notice of Reasons for Rejection and translation for corresponding Japanese Application No. 2004-033946 mailed Nov. 4, 2009.
Japanese Patent Office Action mailed Feb. 9, 2010 (w/English language translation).

* cited by examiner

*Primary Examiner*—Betelhem Shewareged
(74) *Attorney, Agent, or Firm*—Oliff & Berridge, PLC

(57) ABSTRACT

A transfer member of an image forming material for electrophotography, the transfer member including a substrate and an image receiving layer disposed on at least one surface of the substrate. The image receiving layer includes at least a releasing material and has a surface resistivity of $1.0\times10^{8}$ to $3.2\times10^{13}\Omega/\square$ at 23° C. and 55% RH.

4 Claims, 3 Drawing Sheets

TRANSFER MEMBER OF IMAGE FORMING MATERIAL FOR ELECTROPHOTOGRAPHY AND MEMBER HAVING IMAGE RECORDED THEREON USING THE SAME

CROSS-REFERENCE TO RELATED APPLICATION

This application claims priority under 35 USC 119 from Japanese Patent Application No. 2004-33946, the disclosure of which is incorporated by reference herein.

BACKGROUND OF THE INVENTION

1. Field of the Invention

The present invention relates to a transfer member (transfer sheet) of an image forming material for electrophotography for forming (recording) a fine image on an image recording member using an electrophotographic image forming device. The invention also relates to a member having an image recorded thereon, a method for producing a member having an image recorded thereon by using the transfer member, and an apparatus for producing the member having an image recorded thereon using the transfer member. More specifically, the invention relates to a transfer member (sheet) of an image forming material for electrophotography for forming a printed image, a method for producing a member having an image recorded thereon using the same, an apparatus for producing a member having an image recorded thereon, and a member having an image recorded thereon which are used for image-containing bodies such as non-contact type or contact-type information recording media including personal information and image information, e.g., a cash card with a facial portrait, an employee ID card, a student ID card, a personal membership card, a residency ID card, various driver's licenses and various qualification certificates, an RFID tag, an image sheet for identification for use in medical institutions or the like, an image display board, a display label or the like.

2. Description of the Related Art

Recently, as image forming technologies have developed, means for forming images having the same quality in large numbers and at low cost by various printing methods such as image intaglio printing, surface printing, planography, gravure printing and screen printing have been known. Such printing methods are used frequently for the preparation of information recording media that include predetermined information and are capable of communicating with an outer device in a contact or non-contact manner, such as an IC card, a magnetic card and an optical card, or a combination thereof.

However, for example, the above screen printing requires many printing plates corresponding to the number of images to be printed. Furthermore, in the case of color printing, more printing plates are additionally required corresponding to the number of colors. Accordingly, these printing methods are not suitable for dealing with individual personal information for identification (e.g., facial portraits, legal names, addresses, dates of birth, various licenses or the like).

The current mainstream of image forming means for dealing with the above-mentioned problems includes image forming methods using a printer employing a sublimatic or a melt-type heat transfer system using an ink ribbon or the like. Such methods can easily print personal information for identification, but still have problems in that resolution decreases with an increase in printing velocity and in that printing velocity decreases with an increase in resolution.

Furthermore, for the heat transfer system, methods for printing on an image recording member using an intermediate transfer member have been disclosed (see, for example, Japanese Patent Application Laid-Open (JP-A) Nos. 5-096871, 7-068812, 8-142365, 8-156302, 9-314875 and 11-291646). However, in each case, a thin colored layer transferred from an ink sheet is formed on the surface of an intermediate transfer member, and unless this colored layer is firmly transferred to the image recording member, fine image quality cannot be obtained. In addition, since the image quality is basically determined by concavity and convexity of the surface of the image recording member, the image quality is maintained by providing a rubber-like elastic layer on the intermediate transfer member so as to increase the adhesion to the image recording member, adhering firmly by pressure, and transferring the image. The surface layer of the intermediate transfer member is basically designed so as to have releasing property, but a rigid surface layer cannot be used because the surface layer is required to follow the above rubber-like elastic layer. Accordingly, silicone or fluorine rubber is specifically used for the surface layer.

On the other hand, image forming (printing) by an electrophotographic system is carried out by a method of uniformly charging the surface of the image recording member, exposing the surface of an image recording member according to an image signal, forming an electrostatic latent image by potential difference between the exposed portion and the non-exposed portion, and statically developing color powder (image forming material), which is called toner and has the opposite (or the same) polarity to that of the charged potential to form a visible image (toner image) on the surface of the image recording member surface. A color image is obtained by a method of repeating the above-mentioned steps several times, or a method of placing plural image forming devices in parallel to form color visible images, and transferring and fixing (fixation: fixing mainly by fusing of color powder by heat and cooling thereof) these images onto the image recording member to provide a color image.

As mentioned above, according to the electrophotographic system, an electrostatic latent image is electrically formed on the surface of the image recording member using an image signal. Therefore, not only can the same image be formed repeatedly, but the method can easily deal with different images to carry out image formation. Furthermore, the toner image on the surface of the image recording member can be transferred almost completely to the surface of the transfer member or the image recording medium, and residual traces of the toner image remaining on the surface of the image recording member can be easily removed using a resin blade, a brush or the like. Accordingly, printed articles to be produced in various kinds and in small amounts can be easily produced.

The toner is generally formed by melt mixing a hot melt resin and a pigment, along with additives such as an antistatic agent when necessary, and grinding the kneaded product to form microparticles. Furthermore, since the electrostatic latent image obtained in the electrophotographic system has higher resolution than that of the microparticulated toner, more sufficient resolution can be expected as compared with the resolution obtained by the above-mentioned screen printing or heat transfer system using an ink ribbon.

For the color image, quality of color similar to that obtained by printing can be reproduced theoretically by mixing color toners of the four elementary colors of cyan, magenta, yellow and black. Furthermore, since toner resins and pigments can be mixed relatively freely for the color toners, image masking property by the toners can be easily enhanced.

In addition, heat resistance and light resistance of an information recording medium assuming outdoor use has been investigated little. Specifically, when a driver's license is placed in direct sunlight in a vehicle, a heat-transfer type image using a dye as a color material is decolorized. On the other hand, in the case of a color image formed by an electrophotographic system, the light resistance of the image formed by the electrophotographic system is considered to be sufficiently excellent because the color toner comprises pigments having excellent light resistance corresponding to the colors of cyan, magenta, yellow and black. Similarly, it is considered that the heat resistance of the image formed on the information recording medium can be increased to the level that allows outdoor use by choosing and using a toner having heat resistance.

Moreover, a substrate (core) most frequently used for various cards at the present time is a vinyl chloride sheet, since it has excellent printing property and excellent embossing suitability (concavity and convexity treatment for letters or the like) for use in conventional printing machines. However, the vinyl chloride sheet has a problem in that dioxin is generated when cards disposed due to expiration or the like are burned in a heating furnace or the like. Accordingly, in view of effect on the environment, various sheet films are currently used for the purpose of excluding use of vinyl chloride.

For the preparation of a card, based on the presupposition that embossing is not carried out, a conventional biaxial oriented PET (polyethylene terephthalate) film or the like can be used. However, in many cases, embossing is indispensable for maintaining the conventional functions of cards. Accordingly, an ABS resin film and a polyolefin resin film, which soften at relatively low temperature, a modified PET resin film called as PETG, which is obtained by copolymerizing at least ethyleneglycol, terephthalic acid and 1,4-cyclohexanedimethanol, an integrally-molded film of a modified PET resin film and a PET film, amorphous PET resin film or polycarbonate resin film or the like are currently used.

As an example of a method for printing on various cards using the above-mentioned electrophotographic apparatus, for example, JP-A No. 2001-92255 discloses a method of printing an invisible barcode as well as personal information on a vinyl chloride sheet having a thickness of 250 μm or a polyester sheet having a thickness of 280 μm by electrophotographic means, superposing an overcoat film on the printed surface, and laminating the film using a heat press.

However, the above-mentioned sheet has poor sheet conveying property because the frictional coefficient between the sheets is too high and the sheets adhere firmly. Therefore, the electrophotographic apparatus stops, and in the case where the above-mentioned insulator (sheet) having a thickness of no less than 250 μm is used, the image forming material (toner) is difficult to transfer sufficiently, which sometimes leads to increased deficiency of an image. Furthermore, when the resin film that softens at comparatively low temperature is used for the electrophotographic apparatus to try to form an image, there arises a problem in that adhesiveness property is exhibited during the step for fixing because the fixing temperature is higher than the softening temperature of the film, and the film winds around the fixing device and causes jamming. In addition, when the image forming material offsets on the fixing device or when the fixing of the sheet having a thickness of not less than 250 μm is continued, the fixing device is unnecessarily damaged by edges of the sheet, which frequently requires replacement of components.

As another example, JP-A No. 11-334265 discloses a method for printing personal information for identification on a light transmission sheet in which the printing is carried out using a mirror image. However, the document merely discloses that the light transmissive laminate sheet is preferably a film at least a part of which comprises a biaxial oriented polyester film, ABS or polyester (a biaxial oriented polyester film) and that vinyl chloride may be used.

Accordingly, since the film is merely an insulating material in this document, transfer deficiency of the image forming material on the film surface or the like may occur, and a similar level of resolution to that obtained by a heat transfer system or the like cannot be obtained. Furthermore, since this device puts emphasis on the improvement of productivity and the laminate sheet used for the device has a rolled shape, there arises a problem in that great loss and waste are generated upon dealing with the production of urgent matter or various kinds or the like, such as different printing for cards for one to several persons.

Furthermore, when an information recording medium is produced using the above laminate sheet, plural sheets are superposed, which provides a thick recording medium as a whole. For example, when an information recording medium having a thickness of about 800 μm is used, the above-mentioned method sometimes cannot deal with the demands of the medium.

In addition, automation of a step for conveying and stacking a laminate sheet or the like on which an image has been fixed and a plastic substrate and a step for laminating, as well as a step for forming an image on a laminate sheet, have been investigated little. Therefore, in view of improvement of productivity, further design of the above steps and the production device is required.

SUMMARY OF THE INVENTION

The present invention has been made in view of the above-described circumstances and provides an image forming material transfer member (sheet) for electrophotography, which can transfer the image formed by electrophotographic means on an image recording member while keeping fine resolution of the image. The invention also provides a member having an image recorded thereon using the transfer member, and a method for producing a member having an image recorded thereon using the transfer member. Further, the invention also provides an apparatus for producing a member having an image recorded thereon using a conventional electrophotographic apparatus as image forming means without significant modification, by which an image having high resolution can be recorded on a plastic sheet or the like with high productivity.

In addition to the above-mentioned problems, the present inventors have done intensive investigation on the following matters. For example, (1) a method for improving conveying property by adding microparticles to the image receiving layer, (2) a method for forming an image as a mirror image so that the image can be seen as a normal image where the image is visually observed through the substrate from the opposite surface to the surface at which the image has been formed, (3) decreasing frictional coefficient of the surfaces of the image forming material transfer bodies to improve conveying property in the image forming device by using a polyester resin or a polyacetal resin as a resin to be incorporated in a film layer such as an image receiving layer provided on the surface of the transfer member and by adding a filler to the film layer, and (4) use of a chlorine-free resin film as a substrate for dealing with environmental problem and investigation of an image fixing method or the like as a printing method suitable for the use.

A first aspect of the present invention is to provide a transfer member of an image forming material for electrophotography. The transfer member comprises a substrate and an image receiving layer disposed on at least one surface of the substrate. The image receiving layer comprises a releasing material and has a surface resistivity of $1.0\times10^{8}$ to $3.2\times10^{13}\Omega/\square$ at 23° C. and 55% RH.

A second aspect of the present invention is to provide a member having an image recorded thereon. The image is recorded by: forming an image as a mirror image, with an image forming material by electrophotographic means, on an image receiving layer of a transfer member of an image forming material for electrophotography, the transfer member comprising a substrate and the image receiving layer disposed on at least one surface of the substrate, wherein the image receiving layer comprises at least a releasing material and has a surface resistivity of $1.0\times10^{8}$ to $3.2\times10^{13}\Omega/\square$ at 23° C. and 55% RH; adhering a surface, of the transfer member, at which the image has been formed to at least one surface of an image recording member by heat and pressure; allowing the image forming material to cool; and removing the transfer member from the image recording member, whereby the image forming material is transferred to the image recording member.

A third aspect of the present invention is to provide a method for producing a member having an image recorded thereon. The method comprises: forming an image as a mirror image, with an image forming material by electrophotographic means, on an image receiving layer of a transfer member of an image forming material for electrophotography, the transfer member comprising a substrate and the image receiving layer disposed on at least one surface of the substrate, wherein the image receiving layer comprises at least a releasing material and has a surface resistivity of $1.0\times10^{8}$ to $3.2\times10^{13}\Omega/\square$ at 23° C. and 55% RH; placing the transfer member on an image recording member so that the surface, of the transfer member, at which the image has been formed faces toward at least one surface of the image recording member; adhering the transfer member to the image recording member by heat and pressure; allowing the image forming material to cool; and removing the transfer member from the image recording member, whereby the image forming material is transferred to the image recording member to record the image.

A fourth aspect of the present invention is to provide an apparatus for producing a member having an image recorded thereon. The apparatus comprises: a transfer member housing unit for housing a transfer member of an image forming material for electrophotography, the transfer member comprising an image receiving layer disposed on at least one surface thereof; an image forming unit for forming an image as a mirror image, with an image forming material by electrophotographic means, on the image receiving layer of the transfer member; an image recording member housing unit for housing an image recording member; a positioning unit for placing the transfer member on the image recording member so that the surface, of the transfer member, at which the image has been formed faces toward at least one surface of the image recording member; a heating and pressurizing unit for adhering the transfer member to the image recording member by heat and pressure; and a removing unit for removing the transfer member from the image recording member after the image forming material has been cooled, whereby the image forming material is transferred to the image recording member to record the image.

According to the invention, a transfer member having excellent image receiving performance and transfer property can be provided. In addition, according to the method for producing a member having an image recorded thereon using the transfer member and the apparatus for producing the same, a member having an excellent image recorded thereon can be provided.

DETAILED DESCRIPTION OF THE INVENTION

Figure 1:
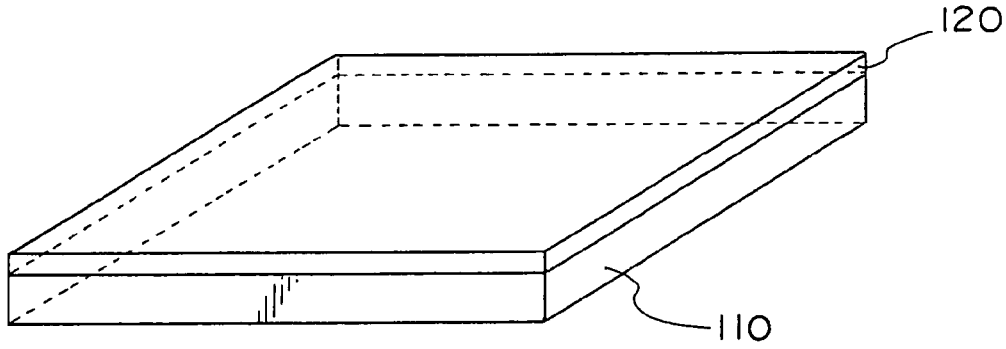
FIG. 1 is a schematic perspective view illustrating an example of a transfer member of an image forming material for electrophotography of the present invention.

Hereinafter, the present invention is explained in detail.

(Transfer Member of Image Forming Material for Electrophotography)

The image forming material transfer member (sheet) for electrophotography of the invention (hereinafter, sometimes referred to as "transfer member" or "transfer sheet") comprises a substrate and an image receiving layer disposed on at least one surface of the substrate. The image receiving layer contains at least a releasing material and has a surface resistivity of $1.0\times10^{8}$ to $3.2\times10^{13}\Omega/\square$ at 23° C. and 55% RH.

Since the image receiving layer provided on the surface of the transfer member of the invention has a suitable range of surface resistivity, a fine image can be formed without transfer deficiency or the like even during image forming using an electrophotographic system. Furthermore, the image receiving layer comprises a releasing material, and the releasing material can transfer finely the image forming material mentioned below on an image recording member and can provide excellent image fixing property for electrophotography.

Therefore, according to the invention, a transfer member (sheet) that can provide a high quality image by electrophotographic method can be provided.

The releasing material of the invention is used for an image receiving layer that stabilizes and fixes the image forming material on a transfer member once, then releases the image forming material when the material is adhered to an image recording member by heat and pressure. Therefore, it is desired that the releasing material have adhesion property and releasing property against a toner generally used as an image forming material for electrophotography.

Such releasing material is, although it is not specifically limited, preferably those comprising a silicone hard coating material in view of releasing property and capability of suppressing a scratch of a surface layer of a film during conveyance of the film, because a scratch on the surface of the film before image forming deteriorates the quality of the image.

The silicone hard coating material used in the invention comprises at least a condensed resin comprising at least a silane composition, or a mixed composition of the composition and a colloidal silica dispersion liquid. Furthermore, it is desirable that the silicone hard coating material further comprises an organic resin for improving adhesiveness to the substrate.

The silane composition is specifically an organic silicon compound such as a silane compound, a fluorine-containing silane compound and an isocyanate silane compound, which provides a resin composition by condensation reaction.

Examples of the silane compound may include alkoxysilanes such as $Si(OCH_3)_4$, $CH_3Si(OCH_3)_3$, $HSi(OCH_3)_3$, $(CH_3)_2Si(OCH_3)_2$, $CH_3SiH(OCH_3)_2$, $C_6H_5Si(OCH_3)_3$, $Si(OC_2H_5)_4$, $CH_3Si(OC_2H_5)_3$, $(CH_3)_2Si(OC_2H_5)_2$, $H_2Si(OC_2H_5)_2$, $C_6H_5Si(OC_2H_5)_3$, $(CH_3)_2CHCH_2Si(OCH_3)_3$, $CH_3(CH_2)_{11}Si(OC_2H_5)_3$, $CH_3(CH_2)_{15}Si(OC_2H_5)_3$, $CH_3(CH_2)_{17}Si(OC_2H_5)_3$; silazanes such as $(CH_3)_3SiNHSi(CH_3)_3$; special silylating agents such as $((CH_3)SiNH)_2CO$, tert-$C_4H_9(CH_3)_2SiCl$; silane coupling agents; and silane compounds such as $HSC_3H_6Si(OCH_3)_3$; and a hydrolysate thereof and a partial condensate thereof.

Examples of the silane coupling agent may include vinylsilanes such as vinyltris(β-methoxyethoxy)silane, vinyltriethoxysilane, vinyltrimethoxysilane; acrylsilanes such as γ-methacryloxypropyltrimethoxysilane; epoxysilanes such as β-(3,4-epoxycyclohexyl)ethyltrimethoxysilane, γ-glycidoxypropylmethyldiethoxysilane; aminosilanes such as N-β-(aminoethyl)-γ-aminopropylmethyldimethoxysilane, γ-aminopropyltriethoxysilane and N-phenyl-γ-aminopropyltrimethoxysilane.

Examples of the fluorine-containing silane compound may include silane compounds such as fluorine-containing silane compounds such as $CF_3(CH_2)_2Si(OCH_3)_3$, $C_6F_{13}C_2H_4Si(OCH_3)_3$, $C_7F_{15}CONH(CH_2)_3Si(OC_2H_5)_3$, $C_8F_{17}C_2H_4Si(OCH_3)_3$, $C_8F_{17}C_2H_4SiCH_3(OCH_3)_2$, $C_8F_{17}C_2H_4Si(ON{=}C(CH_3)(C_2H_5))_3$, $C_9F_{19}C_2H_4Si(OCH_3)_3$, $C_9F_{19}C_2H_4Si(NCO)_3$, $(NCO)_3SiC_2H_4C_6F_{12}C_2H_4Si(NCO)_3$, $C_9F_{19}C_2H_4Si(C_2H_5)(OCH_3)_2$, $(CH_3O)_3SiC_2H_4C_8F_{16}C_2H_4Si(OCH_3)_3$ and $(CH_3O)_2(CH_3)SiC_9F_{18}C_2H_4Si(CH_3)(OCH_3)_2$, and a hydrolysate thereof or a partial condensate thereof.

Examples of the isocyanate silane compounds may include $(CH_3)_3SiNCO$, $(CH_3)_2Si(NCO)_2$, $CH_3Si(NCO)_3$, vinylsilyltriisocyanate, $C_6H_5Si(NCO)_3$, $Si(NCO)_4$, $C_2H_5OSi(NCO)_3$, $C_8H_{17}Si(NCO)_3$, $C_{18}H_{37}Si(NCO)_3$ and $(NCO)_3SiC_2H_4(NCO)_3$.

Examples of the condensed resin of the silane composition of the invention may include thermosetting and photocurable silicone resins (condensation-type and addition-type), and specific examples thereof are as follows.

Among the above-mentioned thermosetting silicone resins, examples of the condensation-type curable silicone resin may include a curable silicone resin synthesized by using a polysiloxane such as polydimethylsiloxane having silanol group at the end as a base polymer, incorporating polymethylhydrogensiloxane or the like as a crosslinking agent and condensing the mixture under heating in the presence of an organic acid metal salt such as an organic tin catalyst and amines or the like; a curable silicone resin synthesized by reacting a polydiorganosiloxane having reactive functional group such as hydroxyl group, alkoxy group or the like at the end; a polysiloxane resin synthesized by condensing a chlorosilane having three or more functionality or a silanol obtained by hydrolysis of the chlorosilane and mono or bifunctional chlorosilane.

The condensation-type is classified into solution-type and emulsion-type in form, and either of which can be preferably used.

Among the thermosetting silicone resins, examples of the addition-type curable silicone resin may include a curable silicone resin synthesized by using a polysiloxane such as a polydimethylsiloxane having vinyl group as a base polymer, incorporating polydimethylhydrogen siloxane as a crosslinking agent and reacting the mixture in the presence of a platinum catalyst to complete curing.

The addition-type resin is classified into solvent-type, emulsion-type and non-solvent type in form, and either of which can be preferably used.

Preferable examples of the thermosetting silicone resin obtained by curing of the condensation-type resin or the addition-type resin may include a pure silicone resin, a silicone alkyd resin, a silicone epoxy resin, a silicone polyester resin, a silicone acrylic resin, a silicone phenolic resin, a silicone urethane resin and a silicone melamine resin.

Examples of the photocurable silicone resin may include curable silicone resins synthesized using a photocation catalyst and a curable silicone resins synthesized using radical curing system. Alternatively, a modified silicone resin obtained by photocuring reaction of a low molecular weight polysiloxane having hydroxyl group or alkoxy group attached to silicon atom or the like, with an alkyd resin, a polyester resin, an epoxy resin, an acrylic resin, a phenolic resin, a polyurethane or a melamine resin or the like. These can be used solely or used as a combination of two or more kinds.

Specifically, preferable curable silicone resin is an acryl-modified silicone resin (a resin obtained by photocuring reaction of an acrylic resin and a low molecular weight polysiloxane) or a thermosetting silicone resin for the following reason.

The acryl-modified silicone resin comprises, in its molecule, a styrene-acrylic resin that is generally used as an image forming material and acrylic chains having high chemical compatibility with a polyester resin, and also has a silicone resin portion that exhibits releasing property. Therefore, a toner, a portion being easy to adhere to a toner and a portion being difficult to adhere to the toner that exists in a single molecule. Furthermore, since these portions are dissolved homogeneously, image fixing property and image releasing property can be expressed on the scale of molecule.

Furthermore, a transfer member having suitable surface hardness can be produced by suitably controlling the ratio of the acryl-modified silicone resin, the acryl chain and the silicone chain, the curing condition thereof. Moreover, the image fixing property and the image releasing property can be further controlled freely by suitably controlling the amounts to be added of the resins mentioned below, specifically of the polyester resin, the polyvinylacetal resin and the releasing agent.

For the above-mentioned reason, it is desirable to use a thermosetting silicone resin, specifically an acryl-modified silicone resin.

The curable silicone resin can comprise both the acryl-modified silicone resin and the thermosetting silicone resin.

When both the acryl-modified silicone resin and the thermosetting silicone resin are comprised in the resin, the intermediate property of these resins can be exhibited depending on the ratio, curing condition, amounts or the like of them, whereby the image fixing property and image releasing property can further be controlled arbitrary.

When the curable silicone resin containing both the acryl-modified silicone resin and the thermosetting silicone resin are contained is used, the mass ratio contents thereof (acryl-modified silicone resin/thermosetting silicone resin) is, although it cannot be determined generally since it varies depending on the kind of the curable silicone resin or the like, preferably in the range of 1/100 to 100/1, more preferably in the range of 1/10 to 10/1.

Furthermore, when both the curable silicone resin containing the acryl-modified silicone resin and the thermosetting silicone resin are contained is used, preferable examples of the combination may include, a combination of an acryl-modified silicone resin and a silicone alkyd resin, a combination of an acryl-modified silicone resin and a pure silicone resin, a combination of an acryl-modified silicone resin and a silicone alkyd resin.

The molecular weight of the curable silicone resin is preferably in the range of 10,000 to 1,000,000 by weight average molecular weight. The ratio of phenyl group to the whole organic groups in the curable silicone resin is preferably in the range of 0.1 to 50% by mole.

It is desirable that the silicone hard coating material of the invention further contains colloidal silica in an amount of about 5 to 25 parts, and more preferably in an amount of 10 to 15 parts based on 100 parts of the solid content of the condensed resin of the silane composition. In this range, crack in the image receiving layer film can be prevented and optimal level of mechanical strength can be achieved.

The colloidal silica is generally in the form of an aqueous dispersion liquid, or an aqueous/organic solvent dispersion liquid. The method for producing thereof is disclosed in, for example, in U.S. Pat. Nos. 4,914,143, 3,986,997, 5,503,935 and 4,177,315, the disclosures of which are incorporated by reference herein.

The colloidal silica has an average particle diameter of about less than 10 nm diameter, as observed by a transmission electron microscope or the like, and at least about 80% of the colloidal silica particle has a diameter in the range of 6 to 9 nm based on the particle volume.

The image receiving layer in the invention preferably comprises the materials mentioned below in addition to the above-mentioned silicone hard coating material. However, the silicone hard coating material is preferably contained in the image receiving layer in an amount of 0.5 to 98% by mass, more preferably 1 to 95% by mass, based on the whole resin in the image receiving layer. When the content of the silicone hard coating material is less than 0.5% by mass, desirable releasing property sometimes cannot be exhibited. When the content exceeds 98% by mass, transfer/fixing of an image is deteriorated, which sometimes leads to deterioration of the quality of the image.

The image receiving layer of the invention preferably comprises a polyester resin as the organic resin. As mentioned above, since a polyester resin is used for the image forming material, it becomes possible to control the fixing property of the image forming material to the transfer member by incorporating the same kind of resin in the image receiving layer. As the polyester resin, a silicone-modified polyester resin, a urethane-modified polyester resin, an acryl-modified polyester or the like can be used in addition to general polyester resins.

The method for the synthesis of the polyester resin is not specifically limited, for example, the urethane-modified polyester resin can be obtained by condensation reaction of a polyvalent base acid component having generally two or more of carboxyl groups and a glycol component to provide a saturated polyester and reacting the polyester with an organic diisocyanate compound and a chain extension agent.

As the polyvalent base acid, for example, aromatic dicarboxylic acids, for example, a divalent base acid such as terephthalic acid, isophthalic acid, orthophthalic acid, naphthalenedicarboxylic acid, biphenyldicarboxylic acid, 1,5-naphthalic acid can be used. Furthermore, aromatic oxycarboxylic acids such as p-oxybenzoic acid, p-(hydroxyethoxy) benzoic acid, tri- and tetraaromatic carboxylic acids such as trimellitic acid, pyromellitic acid can be used in combination.

Examples of the aliphatic dicarboxylic acid may include succinic acid, adipic acid, sebatic acid, azelaic acid, dodecanedioic acid and dimer acid. Examples of the alicyclic dicarboxylic acid may include 1,4-cyclohexanedicarboxylic acid, 1,3-cyclohexanedicarboxylic acid, 1,2-cyclohexanedicarboxylic acid and an anhydride thereof.

Dicarboxylic acids having polymerizable unsaturated double bond can also be used, and examples thereof may include α,β-unsaturated dicarboxylic acids such as fumaric acid, maleic acid, maleic anhydride, itaconic acid, citraconic acid; alicyclic dicarboxylic acids comprising unsaturated double bond such as 2,5-norbornenedicarboxylic anhydride and tetrahydrophthalic anhydride. Among these, the most preferable acid includes fumaric acid, maleic acid, itaconic acid and 2,5-norbornenedicarboxylic anhydride.

Furthermore, when necessary, hydroxycarboxylic acids such as hydroxypivalic acid, γ-butyrolactone and ε-caprolactone can also be used. The above-mentioned components may be used solely or in combination of two or more kinds.

On the other hand, at least one glycol component selected from, for example, aliphatic glycols having 2 to 10 carbon atoms, alicyclic glycols having 6 to 12 carbon atoms and ether bond-containing glycols.

Examples of the aliphatic glycol having 2 to 10 carbon atoms may include ethyleneglycol, 1,2-propyleneglycol, 1,3-propanediol, 1,4-butanediol, 1,5-pentanediol, neopentylglycol, 1,6-hexanediol, 3-methyl-1,5-pentanediol, 1,9-nonanediol, 2-ethyl-2-butylpropanediol, hydroxypivalic acid neopentylglycol ester and dimethylolheptane.

Examples of the alicyclic glycol having 6 to 12 carbon atoms may include 1,4-cyclohexanedimethanol and tricyclodecanedimethylol.

Examples of the ether bond-containing glycol may include diethyleneglycol, triethyleneglycol and dipropyleneglycol, as well as glycols obtained by adding 1 to several moles of ethyleneoxide or propyleneoxide to the two hydroxyl groups bonded to the aromatic ring of a bisphenol such as 2,2-bis(4-hydroxyethoxyphenyl)propane. When necessary, polyethyleneglycol, polypropyleneglycol or polytetramethyleneglycol may be used.

Examples of the organic diisocyanate compound may include hexamethylene diisocyanate, tetramethylene diisocyanate, 3,3-dimethoxy-4,4'-biphenylene diisocyanate, p-xylylene diisocyanate, m-xylylene diisocyanate, 1,3-diisocyanate-methylcyclohexane, 1,4-diisocyanate-methylcyclohexane, 4,4'-diisocyanate dicyclohexylmethane, isophoronediisocyanate, 2,4-trilenediisocyanate, 2,6-trilenediisocyanate, p-phenylenediisocyanate, diphenylmethanediisocyanate, m-phenylenediisocyanate, 2,4-naphthalenediisocyanate, 3,3'-dimethyl-4,4'-biphenylenediisocyanate, 4,4'-diisocyanatediphenylether and 1,5-naphthalenediisocyanate. Among these, hexamethylenediisocyanate, tetramethylenediisocyanate, isophoronediisocyanate and diphenylmethane diisocyanate are preferable.

Examples of the chain extension agent may include ethyleneglycol, propyleneglycol, neopentylglycol, 2,2-diethyl-1,3-propanediol, polyethyleneglycol, diethyleneglycol, polypropyleneglycol, polytetramethyleneglycol, tricyclodecanedimethylol, bisphenol A ethyleneoxide addact and 1,4-cyclohexanedimethanol. Among these, ethyleneglycol, polyethyleneglycol, neopentylglycol, diethyleneglycol and bisphenol A ethyleneoxide adduct are more preferable.

The above-mentioned polyester resin can be synthesized by, for example, a known method in a solvent at the reaction temperature of 20 to 150° C. and in the presence or absence of a catalyst such as an amine and an organic tin compound. Example of the solvent that can be used for this synthesis may include ketones such as methylethylketone, methylisobutylketone and cyclohexanone, aromatic hydrocarbons such as toluene and xylene, esters such as ethyl acetate and butyl ester.

The above-mentioned polyester resins may be used solely or as a mixture of two or more kinds. In the invention, the polyester resin may be contained in the image receiving layer, preferably in a range of 5 to 1000 parts, and more preferably in a range of 10 to 800 parts based on 100 parts of the silicone hard coating material.

Furthermore, in order to improve adhesiveness with a substrate or to improve blocking property or the like, when necessary, a conventional known resin may be mixed and used as a resin material for constituting the image receiving layer. The resin material is preferably a polyvinylacetal resin.

The polyvinylacetal resin used in the invention means a resin obtained by acetalation of polyvinyl alcohol (PVA). Examples of the polyvinylacetal resin may include mainly a polyvinyl butyral resin obtained by reacting PVA with butyl aldehyde, a polyvinylformal resin obtained by PVA with formaldehyde, or a partially formalated butyral resin (or a butyralated formal resin) obtained by reacting butyl aldehyde with formaldehyde by various ratio. Although the polyvinyl acetal resin is a material obtained by acetalation of PVA, it cannot be acetalated completely. P. J. Flory that the theoretical acetalation degree thereof is 81.6 mol %. Furthermore, it is presumed that the actural acetalation degree is slightly lower than the theoretical value since a little amount of acetyl group remains during the preparation of PVA. Accordingly, the physical and chemical properties of the polyvinylacetal resin vary depending on acetalation degree, and composition ratio of hydroxyl group and acetyl group, and heat or mechanical property and solution viscosity of the resin varies depending on its polymerization degree thereof.

For example, it has been known that when the acetalation degree of the resin increases, solubility against solvents other than water and water resistance increase, compatibility with an ester or a plastizer increases and flexibility increases. Furthermore, as the polymerization degree increases, film strength and softening point increase, and solution viscosity also increases.

On the other hand, when a polyvinyl butyral resin and a polyvinylformal resin are compared, the polyvinyl butyral resin has higher solubility, adhesive property (adhesion) and plasticity than those of the polyvinylformal resin, whereas the polyvinylformal resin has higher heat resistance and resistance against abrasion and scratch than those of the polyvinyl butyral resin.

It is preferable to incorporate the polyvinylacetal resin in the image receiving layer in the invention for the following reasons.

Firstly, when the polyvinylacetal resin is used for the image receiving layer, adhesive property (adhesion) to a PET film or the like as a substrate, and adhesiveness to the image forming material can be improved. Furthermore, the resin has good compatibility with and can be dissolved in a releasing agent such as WAX or the like, a resin and a curable silicone resin in the image receiving layer and a releasing agent mentioned below, whereby transparency of the film can be maintained. Furthermore, crosslinking reaction can provide a three dimensional structure by using a reactive silane compound having a functional group, which is one of the releasing agents mentioned below, which can improve the heat resistance and hardness of the surface of the image receiving layer for repetitive fixing and removal of the image and can achieve a stable long time use.

The average polymerization degree of the polyvinyl acetal resin is preferably in the range of 200 to 3,000, and more preferably in the range of 300 to 2,000. When the average polymerization degree is less than 200, performances of the polymer cannot be exhibited, for example, film strength or the like may become insufficient. On the other hand, when the average polymerization degree exceeds 3,000, the coating solution viscosity becomes too high, which sometimes leads to difficulty in controlling of the film thickness of the coated film.

In the present invention, it is preferable that at least two kinds of polyvinylacetal resin each having different average polymerization degree are simultaneously mixed and used. The mediate property thereof can be exhibited depending on the content ratio, condition of curing and amount to be added or the like, which allows further free control of image fixing property, image releasing property and film strength.

In the present invention, the polyvinylacetal resin may be contained in the image receiving layer, preferably in an amount of 5 to 1000 parts, and more preferably in an amount of 10 to 900 parts, based on 100 parts of the silicone hard coating material.

Furthermore, as the resin used for the image receiving layer of the invention, those known as a thermosetting resin that cures (becomes insoluble) upon heating can also be applied. Examples thereof may include a phenol-formaldehyde resin, an urea-formaldehyde resin, a melamine-formaldehyde resin, a resin obtained by curing acrylpolyol with isocyanate, a resin obtained by curing polyester polyol with melamine, and a resin obtained by curing acrylic acid with melamine. Alternatively, monomers being components of the thermosetting resin can be used in combination.

In addition to the above, a thermoplastic resin can also be used similarly to the thermosetting resin as far as it is a resin curable by crosslinking and having heat resistance. For such resin, for example, a thermosetting acrylic resin is preferable. The thermosetting acrylic resin is a resin obtained by copolymerizing at least one kind of acrylic monomer, or an acrylic monomer and a styrenic monomer to provide a polymer, and crosslinking the polymer with a melamine compound or an isocyanate compound.

Examples of the acrylic monomer may include, for example, methacrylic acid alkyl esters such as methyl methacrylate, butyl methacrylate, octyl methacrylate and stearyl methacrylate; acrylic acid alkyl esters such as ethyl acrylate, propyl acrylate, butyl acrylate and octyl acrylate; acrylonitrile; amino group-containing vinyl monomers such as acrylamide, methacrylic acid dimethylaminoethyl ester, methacrylic acid diethylaminoethyl ester, acrylic acid dimethylaminoethyl ester and dimethylamino propylmethacrylamide, and examples of the styrene monomer may includes styrene, α-methylstyrene, vinyltoluene and p-ethylstyrene.

In the invention, when the thermosetting resin or the like is used in the image receiving layer, the content of the thermosetting resin or the like is, for example, preferably in the range of 5 to 1000 parts, and more preferably 10 to 900 parts based on 100 parts of the silicone hard coating material.

Hereinafter, the substrate used in the invention is explained.

The substrate may include, although it is not specifically limited, typically a plastic film. Examples of the preferable plastic film may include films having light transmissivity that can be specifically used as an OHP film such as polyacetate film, cellulose triacetate film, nylon film, polyester film, polycarbonate film, polysulfone film, polystyrene film, polyphenylenesulfide film, polyphenyleneether film, cycloolefin film, polypropylene film, polyimide film, cellophane and ABS (acrylonitrile-butadiene-styrene) resin film.

Among the above-mentioned various plastic films, polyester film, specifically PETG obtained by replacing about a half of the ethyleneglycol component in PET (polyethyleneterephthalate) comprising ethyleneglycol and terephthalic acid with 1,4-cyclohexane methanol component and copolymerizing is excellent. The above-mentioned PETG alloyed by mixing polycarbonate may also be used. Further, an amorphous polyester called A-PET, which is a PET that is not biaxially oriented, may be preferably used.

The polyester resin obtained by copolymerizing at least ethyleneglycol, terephthalic acid and 1,4-cyclohexanedimethanol components (hereinafter sometimes abbreviated to as "PETG resin") has excellent compatibility with components such as a resin included in the coating solution used for the formation of the image receiving layer on the substrate surface. Accordingly, when the PETG resin is used for the surface of the substrate, the substrate and the image receiving layer provided in contact with the substrate surface adhere strongly, whereby removal of the image receiving layer can be prevented.

The substrate used in the invention is preferably constituted of two or more of layers in view of the heat and pressurization property (laminate property) with the image recording member mentioned below.

In this case, for example, it is preferable that at least either of the layers that form the outer surface of the substrate comprises the PETG resin. Such layer may be a layer comprising substantially only the PETG resin. Since the PETG resin has a softening point of about 80° C., heating and pressurizing can be easily carried out. Accordingly, a layer comprising the PETG resin has excellent laminate property.

However, in this temperature range, a layer comprising the PETG resin, particularly a layer comprising substantially only the PETG resin, can be deformed easily. Accordingly, in order to avoid such deformation, a substrate is preferably constituted of a layer comprising the PETG resin and a layer comprising components other than the PETG resin. As the material that constitutes the latter layer, a polyester resin having higher softening point than that of the PETG resin is preferable, and examples of the desirable material may include, polycarbonate and polyarylate, and a mixture or copolymer thereof, or polyethylene terephthalate (PET). Specifically, when PET is used for a biaxial oriented film, the film has high elasticity upon heating and high resistance against deformation. Accordingly, when the layer (film) comprising the PETG resin is combined with a layer (film) having high elasticity upon heating and high resistance against deformation, winding of the transfer member around a fixing apparatus during fixing of an image can be readily prevented.

The above-mentioned polycarbonate is a polycondensate obtained from a bisphenol and carbonic acid, and the polyarylate is a polyester obtained from polycondensation of a bisphenol and an aromatic dicarboxylic acid. Polyarylate generally has higher heat resistance than that of polycarbonate, since it comprises rigid aromatic rings in a main chain at high density.

Examples of the above-mentioned bisphenol may include bisphenol A (2,2-bis(4-hydroxyphenyl)propane), bisphenol C (4,4'-(1-methylethylidene)bis(2-methylphenol)), bisphenol AP (4,4'-(1-phenylethylidene)bisphenol), bisphenol Z (4,4'-cyclohexylidenebisphenol), 4,4'-cyclohexylidenebis(3-methylphenol), 5,5'-(1-methylethylidene)(1,1'-biphenyl)-2-ol, (1,1'-biphenyl)-4,4'-diol, 3,3'-dimethyl(1,1'-biphenyl)-4,4'-diol, 4,4'-(1,4-phenylenebis(1-methylethylidene)) bisphenol), 4,4'-(1,4-phenylenebis(1-methylethylidene)bis(2-methylphenol)), 4,4'-(1,3-phenylenebis(1-methylethylidene)bis(2-methylphenol)) and bisphenol S (4,4'-bis(dihydroxydiphenylsulfone), and bisphenol A is frequently used. These may be used solely or used as a mixture of two or more kinds of mixed.

Examples of the aromatic dicarboxylic acid may include terephthalic acid, isophthalic acid, oxalic acid, malonic acid, succinic acid, adipic acid, itaconic acid, azelaic acid, sebatic acid, eicosadiacid, naphthalenedicarboxylic acid, diphenic acid, dodecanediacid and cyclohexanedicarboxylic acid. These raw material are not necessarily used solely and two or more kinds may be copolymerized. Among these, when a mixture of terephthalic acid component and/or isophthalic acid is used, the polyarylate obtained has preferable melt processing property and general performance. When such mixture is used, the mixing ratio thereof can be selected arbitrarily, and a range where the ratio of the terephthalic acid component/isophthalic acid component=9/1 to 1/9 (mol ratio) is preferable. Specifically, in view of balance of melt processing property and performance, preferable range is 7/3 to 3/7 (mol ratio), and more preferable range is 1/1 (mol ratio).

The method for producing the substrate used in the invention is arbitrary, and the substrate can be produced by a known method such as coextrusion method and lamination method. Specifically, a substrate produced by coextrusion is desired because adhesive force between the layers is strong. For example, when a substrate is a laminate of film 1 (layer I) comprising the above-mentioned polycarbonate, polyarylate, a copolymer thereof, or PET, and film 2 (layer II) comprising the PETG resin on one surface or both surfaces, the substrate can be produced, for example, according to the following method.

An unstretched film can be obtained by coextrusion method for laminating film 2 (layer II) on one surface or both surfaces of film 1 (layer I), which comprises feeding a composition that constitutes film 1 (layer I) and a composition that constitutes film 2 (layer II) in separate extruders and extruding the compositions in melted state from a single die while laminating.

The unstretched film can be directly used as a substrate. Alternatively, the unstretched film may be subjected to biaxial orientation treatment by stretching between rolls having different velocities (roll stretching), by stretching comprising holding the film with crips and extending the film (roll stretching), or by stretching (inflation stretching) comprising extending the film using air pressure, and the treated film can be used as a substrate.

A method for producing a substrate generally comprises, after the coextrusion, a step for stretching the film longitudinally to stretch the film between two or more rolls each having different peripheral velocity for adjusting film thickness to the desired level, and winding the film. When biaxially drawing is applied, the film subjected to the above-mentioned step is directly introduced in a tenter and stretched in the width direction by 2.5 to 5-folds. During this step, preferable stretch temperature is in the range of 100° C. to 200° C.

The thus-obtained biaxial oriented film is subjected to heat treatment when necessary. The heat treatment is preferably carried out in a tenter. Specifically, when the heat treatment is carried out with relaxing the film in the longitudinal and width directions, a film having low heat shrinkage ratio can be obtained.

The transfer member of an image forming material for electrophotography of the invention is required to have an image receiving layer, which is disposed on the substrate, having a surface resistivity of in a range of $1.0\times10^{8}$ to $3.2\times10^{13}\Omega/\square$. The surface resistivity is more preferably in a range of $1.0\times10^{9}$ to $1.0\times10^{11}\Omega/\square$.

When the surface resistivity is less than $1.0\times10^{8}\Omega/\square$, the surface resistivity of the transfer member (sheet) becomes too low, especially when the transfer member is used as an image receiving member under high temperature and high humidity. As a result, for example, a toner transferred from a primary transfer member in an electrophotographic apparatus may be disordered. On the other hand, when the surface resistivity exceeds $3.2\times10^{13}\Omega/\square$, the surface resistivity of the image forming material transfer member that is used as an image receiving member becomes too high, and the toner from the primary transfer element in an electrophotographic apparatus cannot be transferred to the surface of the transfer member, which leads to deficiency in the image due to transfer deficiency.

For the same reason, when the image receiving layer is provided only one surface of the substrate, the surface resistivity of the substrate surface on which in image receiving layer is not provided is preferably in the range of $1.0\times10^{8}$ to $3.2\times10^{13}\Omega/\square$, more preferably in the range of $1.0\times10^{9}$ to $1.0\times10^{11}\Omega/\square$.

The difference in surface resistivities of the two surfaces of the image forming material transfer member for electrophotography of the invention at 23° C. and 55% RH is preferably within 4 orders of magnitude, and more preferably within 3 orders of magnitude. If the difference in the surface resistivities of the two surfaces exceeds 4 orders of magnitude, transfer deficiency of a toner would occur, which may lead to deterioration of the image.

The surface resistivities can be measured under the environment at 23° C. and 55% RH using a circle electrode (e.g., "HR probe" of Hiresta IP manufactured by Mitsubishi Chemical Corporation) according to the method of JIS K6911.

For the controlling of the surface resistivities of the image receiving layers provided on the substrate surface within the range of $1.0\times10^{8}$ to $1.0\times10^{13}\Omega/\square$, it is preferable to incorporate an antistatic agent in the image receiving layer. Examples of the antistatic agent may include polymer electroconductive agents, surfactants and electroconductive metal oxide particles.

When the image receiving layer is provided on only one surface of the substrate, the surface resistivity of the substrate surface on which in image receiving layer is not provided can be controlled by adding a surfactant, a polymer electroconductive agent and electroconductive microparticles or the like to the resin, by coating the surface of the film with a surfactant, by depositing a thin film of metal, or by adding a surfactant or the like during the production of the film for substrate.

Examples of the surfactant that can be used include cationic surfactants such as polyamines, ammonium salts, sulfonium salts, phosphonium salts and betain amphoteric salts, anionic surfactants such as alkyl phosphates, nonionic surfactants such as aliphatic esters. Among these surfactants, cationic surfactants, which interact greatly with a negatively-charged toner for electrophotography that is currently used, are effective for improvement of transfer property.

Among the above-mentioned cationic surfactants, quaternary ammonium salts are preferable. Preferable quaternary ammonium salt is a compound represented by the following formula (I).

Formula (I)

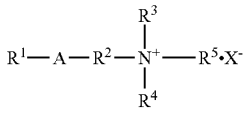

In formula (I), $R^1$ represents an alkyl group having 6 to 22 carbon atoms, an alkenyl group having 6 to 22 carbon atoms or an alkynyl group having 6 to 22 carbon atoms; $R^2$ represents an alkyl group having 1 to 6 carbon atoms, an alkenyl group having 1 to 6 carbon atoms or an alkynyl group having 1 to 6 carbon atoms; and $R^3$, $R^4$ and $R^5$ may be the same or different, and each independently represent an aliphatic group, an aromatic group or a heterocyclic group.

The aliphatic group includes straight chain, branched or cyclic alkyl groups, alkenyl groups or alkynyl groups.

The aromatic group includes benzene monocyclic or condensed polycyclic aryl groups. These groups may have substituents such as a hydroxyl group. A represents an amide bond, an ether bond, an ester bond, a phenyl group, or a single bond (in case of a single bond, A does not exist). $X^-$ represents a halogen, a sulfate ion or a nitrate ion, and each of these ions may have a substituent.

The structure of the layers of the transfer member of the invention is not specifically limited as far as it comprise a substrate and an image receiving layer disposed on at least one surface of the substrate. Hereinafter, the examples of structure of the image forming material transfer member of the invention are explained in detail with referring to drawings. However, the structure of the transfer member of the invention is not limited to the structures shown below.

FIG. 1 is a schematic perspective view showing an example of the image forming material transfer member (sheet) of the invention. The image forming material transfer sheet of the invention shown in FIG. 1 is constituted of substrate 110 and image receiving layer 120 comprising a releasing material.

A fixed image is formed as a reverse image (mirror image) on the transfer sheet so that when an image is transferred to an image recording member, the image on the image recording member shows a normal image (a non-reverse image).

The substrate 110 of the transfer sheet of the invention is preferably transparent. Here, being transparent means transmitting light in visible light region to some extent. In the present invention, the substrate may be transparent to the extent that at least the formed image can be observed visually through the substrate 110 from the opposite surface to the surface on which an image has been formed, because the place of positioning to which the image is transferred, errors on the printed information, displacement or the like can be easily confirmed.

As the substrate 110, the above-mentioned plastic film can preferably be used. The plastic film material can correspond to the trend of the decreased use of polyvinyl chloride that has been used conventionally as a substrate (core) material for cards. Use of polyvinyl chloride has been decreased due to the recognition that polyvinyl chloride is harmful to the environment since dioxin is generated when burning polyvinyl chloride as combustible wastes. In the invention, in view of using a substrate free from chlorine, additional materials such as the above-mentioned polystyrene resin film, an ABS resin film and an AS (acrylonitrile-styrene) resin film, and a film in which a hot melt adhesive such as a polyester or an EVA has been added on a PET film or a polyolefin resin film such as polyethylene or polypropylene are preferably used.

In addition to the above-mentioned plastic films, the material that can be used in combination with the PETG resin may include other transparent resins and transparent ceramics, and these may be colored by addition of a pigment, a dye or the like. The substrate 110 may be of film form or plate form, or may have a thickness to the extent that the film does not have flexibility or that the film has strength generally required for the transfer sheet.

In order to prevent adhesion and winding of the image receiving layer 120 to the fixing member during fixing of the image, the image receiving layer may include a natural wax or a synthetic wax, each is a material having low adhesion to the fixing member, or a releasing agent such as a resin having releasing property, a reactive silicone compound and a modified silicone oil.

Specific examples may include natural waxes such as carnauba wax, honeybee wax, montan wax, pallafin wax, microcrystalline wax, synthetic waxes such as low molecular weight polyethylene wax, low molecular weight oxide type polyethylene wax, low molecular weight polypropylene wax, low molecular weight oxide type polypropylene wax, higher aliphatic acid wax, higher aliphatic acid ester wax, Southall wax. These can be used solely or as a mixture of two kinds or more.

As the resin having a releasing property, a silicone resin, a fluorine resin, or a modified silicone resin, which is a modified resin of a silicone resin with various resins can be added, and examples of the modified silicone resin may include a polyester-modified silicone resin, an urethane-modified silicone resin, an acryl-modified silicone resin, a polyamide-modified silicone resin, an olefin-modified silicone resin, an ether-modified silicone resin, an alcohol-modified silicone resin, a fluorine-modified silicone resin, an amino-modified silicone resin, a mercapto-modified silicone resin, a carboxy-modified silicone resin, a thermosetting silicone resin and a photosetting silicone resin.

The modified silicone resin has high affinity with resin particles including a toner resin as an image forming material and heat fusable resin, and the resins can be suitably mixed, dissolved or melt-mixed. Therefore, the modified silicone resin can provide excellent color developing property of the pigment in the toner, and can prevent adhesion of the fixing member and the transfer member during heat fusing due to releasing property of the silicone resin.

Alternatively, in the invention, both a reactive silane compound and a modified silicone oil may be added as a releasing agent so as to decrease adhesiveness. It has been found that the reactive silane compound reacts with the resin in the image receiving layer and the modified silicone oil, and these act better as a releasing agent than a liquid lubricant in the silicone oil and are fixed strongly in the image receiving layer by curing reaction as a releasing agent, and the releasing agent does not fall even by mechanical abrasion or extraction with a solvent.

These wax and resin having a releasing property may exist as particles similarly to the resin particles of the hot melt resin, and these are preferably used as a mixture in the hot melt resin and these are dispersed and dissolved in the resin.

On the other hand, the surface resistivity of the image receiving layer 120 is, as mentioned above, preferably in the range of $1.0\times10^{8}$ to $3.2\times10^{13}\Omega/\square$. In order to control the surface resistivity in this range, as mentioned above, a polymer electroconductive agent, a surfactant or electroconductive metal oxide particles can be added to the image receiving layer as an antistatic agent. In addition, in order to improve conveying property, it is preferable to add a matt agent to the image receiving layer 120 or a film layer provided on the surface of the substrate (hereinafter sometimes referred to as "film layer" inclusive of the image receiving layer).

The electroconductive metal oxide particles may include ZnO, TiO, $TiO_2$, $SnO_2$, $Al_2O_3$, $In_2O_3$, SiO, $SiO_2$, MgO, BaO and $MoO_3$. These can be used solely or used in combination. The metal oxide preferably comprises additional hetero elements, and preferable examples thereof include ZnO comprising Al, In or the like, TiO comprising (doping) Nb, Ta or the like, $SnO_2$ comprising Sb, Nb, halogen element or the like. Among these, Sb-doped $SnO_2$ is specifically preferable since it has electroconductivity that does not change with time and has high stability.

Examples of the resin having lubricity used for the matt agent may include polyolefins such as polyethylene; fluorine resins such as polyvinyl fluoride, polyvinylidene fluoride, polytetrafluoroethylene (Teflon(R)). Specific examples may include low molecular weight polyolefin wax (e.g., polyethylene wax, molecule weight 1000 to 5000), high density polyethylene wax, pallafin wax and microcrystalline wax.

Examples of the fluorine resin may include a dispersion liquid of polytetrafluoroethylene (PTFE).

In the invention, it is preferable that the image receiving layer 120 comprises a filler in view of fine movability of the transfer sheet.

Examples of the filler used in the invention may include, although it is not specifically limited to, such as organic resin particles, for example, homopolymers and copolymers obtained by copolymerizing one or more of styrenes such as styrene, vinylstyrene and chlorostyrene; monoolefins such as ethylene, propylene, butylenes and isobutylene; vinyl esters such as vinyl acetate, vinyl propionate, vinyl benzoate and vinyl butyrate; α-unsaturated aliphatic acid monocarboxylic acid esters such as methyl acrylate, ethyl acrylate, butyl acrylate, dodecyl acrylate, octyl acrylate, phenyl acrylate, methyl methacrylate, ethyl methacrylate and butyl methacrylate, dodecyl methacrylate; vinylethers such as vinyl methyl ether, vinyl ethyl ether and vinyl butyl ether; vinylketones such as vinyl methyl ketone, vinyl hexyl ketone and vinylisopropenylketone; diene monomers such as isoprene and 2-chlorobutadiene.

Among these, styrenes and esters of α-unsaturated aliphatic acid monocarboxylic acid are preferable. When these hot melt resin are used as a filler, these can be used as a filler that constitutes a gloss controlling layer by applying the resin with a solvent that does not dissolve the resin. More preferably, a thermosetting resin obtained by adding a crosslinking agent to the hot melt resin to form crosslinking structure, or microparticles of the above-mentioned thermosetting resin, photosetting resin or electron beam curable resin.

When the filler is constituted of inorganic microparticles, specific examples thereof may include mica, talc, silica, calcium carbonate, Chinese white, halocite clay, kaolin, hydrochloric magnesium carbonate, quartz powder, titanium dioxide, barium sulfate, calcium sulfate and alumina.

The shape of the filler is generally spherical particle, or may be plate shape, needle shape or amorphous shape.

The volume average particle diameter of the filler is preferably 0.1 to 30 μm. In view of the film thickness of the image receiving layer, the size is preferably at least 1.2 times the film thickness of the image receiving layer. When the size is too large, the filler falls from the image receiving layer 120 (powdering phenomenon), the surface can be easily abraded or scratched, and fogging (haze degree) increases. The filler projects from the surface of the image receiving layer, and the frictional coefficients between the superposed transfer members decrease. As a result, the transfer member can be transported within the electrophotographic apparatus.

The mass ratio of the filler and the binder (resin component) in the image receiving layer of the transfer member is preferably in the range of 0.01:100 to 15:100, and more preferably 0.5:100 to 5:100. When the ratio of the filler is in the above-mentioned range, disorder in the transfer of the image forming material transfer member is decreased, and image quality is fine. When the ratio is lower than the range, the frictional coefficient between the superposed transfer members becomes high, which sometimes lead to jamming in the electrophotographic apparatus. When the ratio exceeds the range, the image is sometimes disordered during transfer of the image forming material.

As the filler, inorganic microparticles (e.g., $SiO_2$, $Al_2O_3$, talc or kaolin) and beads-shaped plastic powder (e.g., crosslinking-type PMMA, polycarbonate, polyethylene-terephthalate, polystyrene) may be used in addition to the above-mentioned fillers.

As mentioned above, the abrasion of the film surface must be decreased in order to improve conveying property of the image forming material transfer member in the electrophotographic apparatus, and the static frictional coefficient of the transfer member surface is preferably not more than 2, more preferably not more than 1 for practical use. The dynamic frictional coefficient of the transfer member surface is preferably in the range of 0.2 to 1, more preferably in the range of 0.3 to 0.65.

The coating layer of the image receiving layer 120 comprising at least a resin, specifically preferably a resin and a filler, and of layers other than the image receiving layer 120 is formed onto the surface of the substrate 110 by the following method.

The above-mentioned layers can be formed by mixing a resin (and when necessary, a filler or the like) with an organic solvent or water, dispersing the mixture homogeneously using a device such as an ultrasonic, a wave rotor, an attriter or a sand mill to produce a coating solution, and applying or dipping the coating solution as it is on the surface of the substrate 110.

As the method for applying or dipping, conventional methods such as blade coating method, wire bar coating method, spray coating method, dip-coating method, bead coating method, air knife coating method, curtain coating method and roll coating method can be adopted.

When the image forming material transfer member has film layers on the both surfaces of the substrate, either of the surfaces can be applied firstly, or both surfaces can be applied simultaneously.

For the preparation of the coating solution, it is preferable to use a good solvent that dissolves the surface of substrate 110 as a solvent. When a good solvent is used, the surface of the substrate 110 dissolve and acts as it is as a binder resin to enhance binding, whereby microparticles such as a matt agent and a filler can be held stably.

A good solvent to the substrate 110 surface means a solvent having higher solubility than the solubility where the solvent contacts on the surface of the substrate 110, the solvent affects on the substrate 110, and the surface of the substrate 110 is slightly eroded (a little haze or the like are observed on the surface after removal of the solvent).

In view of such point, the surface on which the film layer is to be formed of the substrate 110 preferably comprises a PETG resin, which has excellent compatibility with a general solvent used for a coating solution. More preferably, the surface is coated with a resin.

The solvent that induces compatibility between the PETG resin comprised in the surface of the substrate and the resin comprised in the film layer is not specifically limited as far as it is a solvent used for the solvent of a known coating solution. Specific examples may include aromatic hydrocarbons such as toluene and xylene, halogenated hydrocarbons such as methylene chloride and chlorobenzene, ketones such as methylethylketone and cyclohexanone, tetrahydrofuran and ethyl acetate, and mixtures of these solvents and mixed solvent with a poor solvent.

The method for drying during formation of the film layer on the surface of the substrate 110 may be air drying, and the drying can be readily carried out by heat drying. As the method for drying, generally used method such as a method drying in an oven, a method for passing an oven, or a method for contacting with a heat roller or the like can be adopted.

The image receiving layer 120 formed on the surface of the substrate 110 as mentioned above has a thickness preferably in the range of 0.1 to 20 μm, more preferably in the range of 1.0 to 10 μm.

The toner is fixed on the surface of image receiving layer as heat and pressure are simultaneously applied during fixing in the formation of the image on the transfer member. At the same time, during this step, the toner contacts the fixing member, and when the toner has low viscosity or high compatibility with the fixing member, a part of the toner transfers to the fixing member and remains in the fixing member as an offset. As a result, the fixing member is damaged, and the lifetime of the fixing unit is shortened. Accordingly, the transfer member is required to have a sufficient fixing property of toner images and a releasing property with respect to the fixing member.

However, since the surface of the image receiving layer of the transfer member of the invention has good adhesiveness to a toner, the toner can be fixed on the surface of the transfer member at a temperature lower than the temperature at which the toner melts to provide viscosity.

Accordingly, in the invention, it is preferable that fixing of the toner image formed on the surface of the transfer member is carried out while keeping the temperature of the surface of the transfer member (image forming surface) does not exceed the melting temperature of the toner. In view of the melting temperature of the ordinary toner, the surface temperature of the transfer member is preferably kept 130° C. or less, and more preferably 110° C. or less.

Furthermore, even when the fixing is carried out under the above-mentioned condition, in the case of using the transfer member of the invention, the substrate may be heated to the temperature area wherein heat deformation occurs. In this case, specifically the elasticity of the transfer member is weakend, and the sheet tends to wind around a heat roll in a fixing device. In this situation, it is desirable to convey the sheet with paper superposed thereon to compensate the elasticity of the transfer member in the fixing device, or to modify or adjust the fixing device so that a guide hits against a film edge portion.

On the other hand, it is preferable that the transfer member of the invention has high releasing property since the image receiving layer contacts the fixing member also at the non-image portion during fixing. The filler is preferably included in the image receiving layer in order to keep the high releasing property.

As explained above, the transfer member of the invention is excellent in image quality required for elaborately-designed printed articles (color, gloss, masking property or the like) and stability during repetitive steps for image forming by selecting the structure of the substrate and the image receiving layer, materials or the like; provides no deficiency in the image due to scratching or foreign materials; can keep sufficient heat resistance and light resistance even used in the open air; and can prevent offset even during use of an oilless toner.

(Member Having Image Recorded Thereon and Method for Producing the Same)

Hereinafter, the member having an image recorded thereon, wherein the image is formed by using the above-explained transfer member (sheet) of an image forming material for electrophotography of the invention, is explained below. Hereinafter, the member having an image recorded thereon may be referred to as an image-containing member.

Examples of such a member having an image recorded thereon include (1) an image sheet, an image panel and the like which is produced by preparing a toner image according to information on a surface of the transfer member of an image forming material for electrophotography of the invention, and transferring the image to the image recording member by heat and pressure, and (2) an information recording medium and the like, which contains predetermined information and can communicate with an outer device in a contact or non-contact manner, the medium comprising at least an information chip provided on at least one place on an image recording member, wherein, from the chip, information can be at least read by utilizing at least one means selected from the group consisting of electrical means, magnetic means and optical means. Examples of (2) include an IC card, a magnetic card and an optical card, and a combination thereof.

It is preferable that at least the surface to be heated and pressurized with the transfer member of the image recording member used for producing the image-containing member of the invention comprises a polyester resin, specifically an urethane-modified polyester resin. In this case, the transfer member of the invention and the image recording member can be adhered more strongly upon heating and pressurizing.

With respect to the image-containing member of (1), the toner image is not specifically limited. A part or whole of the image may function as information having certain identifiability and the image may act as identifiable information such as image information and letter information. The identification of the toner image as information is not specifically limited whether it can be visually identified or not. The image may be identified mechanically.

With respect to the image-containing member (information recording medium) of (2), the information chip to be used is not specifically limited. The information chip may have information that can be identified by certain means and the information may be read by utilizing at least one means selected from the group consisting of electrical means, magnetic means and optical means. The information chip may be read-only, or may be readable and writable (including "rewritable"). Specific examples of the information chip may include an IC chip (semiconductor circuit).

Even when the above-mentioned information chip is used as an information source for the member having an image thereon, the toner image to be formed is not specifically limited. A part of or whole image may or may not have information having certain identifiability.

The information that the toner image or the information chip has is not particularly limited, and may be identifiable. The information may include variable information. When plural image recording members are prepared according to the same standard or criteria, "variable information" means that the information held by each member is different.

For example, in the case where the toner image comprises variable information, the toner image on the portion corresponding to variable information may include different toner images for each image-containing member.

Further, the variable information may include personal information. In this case, the member having an image recorded thereon (information recording medium) of the invention can be applied to a cash card, an employee ID card, a student ID card, a personal membership card, a residency ID card, various driver's licenses, various qualification certificates or the like. When the member of the invention is used for such applications, the personal information may include, for example, a facial portrait, image information for identification, name, an address, date of birth or the like and a combination thereof.

The member of the invention having an image recorded thereon may be produced by a method comprising: forming an image as a mirror image, with an image forming material by electrophotographic means, on an image receiving layer of a transfer member; placing the transfer member on an image recording member so that the surface, of the transfer member, at which the images has been formed faces toward at least one surface of the image recording member; adhering the transfer member to the image recording member by heat and pressure; allowing the image forming material to cool; and removing the transfer member from the image recording member, whereby the image forming material is transferred to the image recording member to record the image.

The image forming on the transfer member by electrophotography comprises firstly charging the surface of the photosensitive member (image holding member) for electrophotography by uniformly providing electric charge. Next, the image information is irradiated to form an electrostatic latent image. A toner, i.e. an image forming material, is fed from the developing unit to the electrostatic latent image on the surface of the photosensitive member, whereby the electrostatic latent image is visually developed by the toner (a toner image is formed). Thus-formed toner image is transferred to the surface of an image receiving layer of the transfer member, and the toner image is finally fixed on the surface of the image receiving layer by heat, pressure or the like, and the transfer member is ejected from the electrophotographic apparatus.

The transfer member of the invention transfers an image by superposing the image forming surface (the surface on which an image receiving layer has been provided) on an image recording member comprising an IC chip or the like. Therefore, the image formed on the image receiving layer of the transfer member needs to be a reverse image (mirror image). In the formation of the electrostatic latent image on the surface of the photosensitive member, the image information to be developed on the surface of the photosensitive member is preferably in the form of a mirror image.

The image recording member used in the invention is made of metal, plastic, ceramic or the like, and preferably in the form of sheet.

The image recording member used in the invention is preferably a plastic sheet, and specifically preferably a transparent sheet so that the formed image becomes easy to see where the sheet is used as an image recording member. A white plastic sheet is typically used.

The resin for the plastic sheet may be similar to those used for the substrate of the image forming material transfer member for electrophotography, and preferable examples thereof may include polyacetate film, cellulose triacetate film, nylon film, polyester film, polycarbonate film, polystyrene film, polyphenylenesulfide film, polypropylene film, polyamide film, cellophane and ABS (acrylonitrile-butadiene-styrene) resin film.

Among the above-mentioned various plastic films, polyester film, specifically PETG obtained by replacing about a half of the ethyleneglycol component in PET (polyethyleneterephthalate) comprising ethyleneglycol and terephthalic acid with 1,4-cyclohexane methanol component and copolymerizing, is excellent. The above-mentioned PETG alloyed by mixing polycarbonate may also be used. Further, an amorphous polyester called A-PET, which is a PET that is not biaxially oriented may be preferably used.

In the invention, it is preferable that at least the surface on which an image is transferred of the image recording member comprises PETG. Since the image transfer surface comprises PETG, the transferred image forming material (toner) can be buried almost completely in the surface of the image recording member, whereby the form of the surface of the resulted image recording member can be made similarly to that of the surface of the electrophotographic image forming material transfer member.

In the invention, in view of use of a substrate free from chlorine as mentioned above, a polystyrene resin sheet, an ABS resin sheet, an AS (acrylonitrile-styrene) resin sheet and a PET sheet, and a sheet a hot melt adhesive such as polyester, EVA or the like is adhered on a polyolefin resin sheet made of polyethylene, polypropylene or the like, can be also preferably used as an addition material.

The method for whitening a plastic may include a method for incorporating a white pigment such as silicon oxide, titanium oxide, metal oxide microparticles such as calcium oxide, an organic white pigment, polymer particles or the like in a film. Alternatively, a plastic sheet can be whitened by providing the surface of the plastic sheet with sand blaster treatment, embossing or the like, to provide the surface of the plastic sheet with concavity and convexity, and light scattering the concavity and convexity.

The image recording member used in the invention is preferably a plastic sheet having a thickness in the range of 75 to 1000 μm, and more preferably a PETG sheet having a thickness in the range of 100 to 750 μm.

In the case where the resulted image recording member of the invention is used as an IC card or the like, an image recording member comprising semiconductor circuit therein or on the surface thereof can be used.

As the method for housing the semiconductor circuit in the image recording member, a method for interposing a sheet on which the semiconductor circuit has been fixed, which is called inlet, between sheet materials constituting the image recording member and adhering by hot melt adhesion using a hot press to unite the sheets is generally preferably used. Alternatively, a method for placing the semiconductor circuit directly without the inlet sheet and adhering by hot melt adhesion can be also used.

Alternatively, the semiconductor circuit can be housed in the image recording member without using the above-mentioned hot melt adhesion but using an adhesive such as Hot Melt or the like to adhere the sheets constituting the image recording members. However, the method is not limited to these methods, and any method for housing a semiconductor circuit in an IC card can be used for the method for producing the image recording member.

The semiconductor circuit can also be positioned not internally in the image recording member, but on the surface thereof, unless the image recording member causes any problem during use.

When the image recording member of the invention is used as a magnetic card or the like as well as an IC card, an antenna, a magnetic stripe, an outer terminal or the like are buried in the image recording member when necessary. In addition, a magnetic stripe, a hologram or the like are sometimes printed on the image recording member, and letter information is sometimes embossed thereon when necessary.

The superposing of the image forming material transfer member for electrophotography on the image recording member may be carried out by holding and aligning the image forming material transfer member for electrophotography and image recording member by hands, or by ejecting subsequently the transfer member and the image recording member on a collating tray after image forming on the transfer member to automatically aligning the transfer member and the image recording member.

The adhesion method in the heating and pressurizing is not specifically limited, and conventionally-known lamination methods and laminate devices may be adopted. Among these methods, heat press method for laminating by heat is preferable. For example, the adhesion can be carried out by using a conventional lamination method for penetrating a laminated body comprising a transfer member and an image recording member to a pressure-welding portion (nip portion) in a pair of heatable heat roll to heat-melt the sheet and the image recording member and adhering by hot melt adhesion, and a conventional laminate device.

In the heating and pressurizing of the invention, a transfer member on which an unfixed image has been formed may be used. In this case, the color development property of the toner or the like can be ensured by raising the temperature during heating and pressurizing slightly higher than the temperature used in the case where a transfer member that has been fixed is used.

The laminated body after heating and pressurizing is formed into the image recording member of the invention, by solidifying the image forming material under cooling, removing the image forming material transfer member for electrophotography from the image recording member, and transferring the image forming material on the image recording member to record an image.

The temperature for solidifying under cooling is specifically a temperature not more than the softening point of the toner where the toner sufficiently solidifies, for example, a temperature at not more than the glass transition temperature of the image forming material, preferably in the range from the ordinary temperature to 30° C. The condition for removing the transfer member from the image recording member is not specifically limited. Preferably, the removing is carried out by clipping the end surface of the transfer member and removing the sheet gently from the image recording member.

Figure 2A:
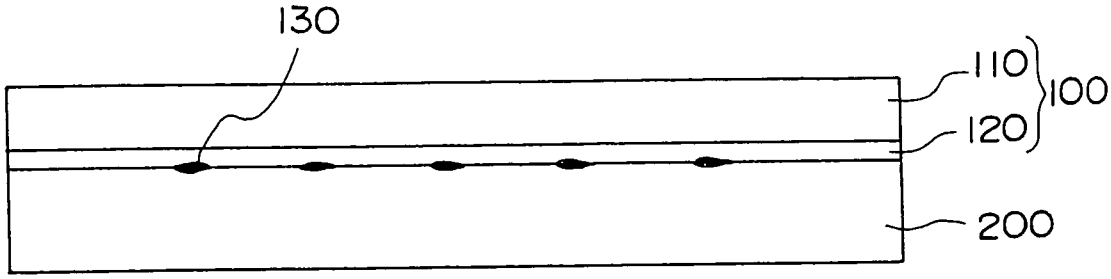
FIG. 2A is a cross-sectional view illustrating the state of a laminated body, including a member having an image recorded thereon of the invention, before adhesion by heat and pressure.
Figure 2B:
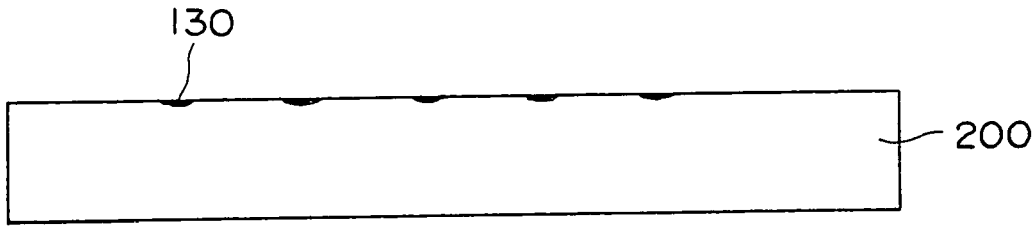
FIG. 2B is a cross-sectional view illustrating the state of the member having an image recorded thereon of the invention after adhesion by heat and pressure.

The specific example of the above-mentioned information recording medium is explained by referring to drawings. FIG. 2A is an example of a cross sectional view illustrating a state of a laminated body (a member having an image recorded thereon and a transfer member) before heating and pressurizing in the production process thereof. FIG. 2B is an example of a cross sectional view illustrating a state of the member having an image recorded thereon after removing the transfer member. In FIGS. 2A and 2B, 100 is a transfer sheet of an image forming material for electrophotography, and 200 is an image recording member (image supporting member).

FIG. 2A shows the state wherein the image forming material transfer sheet 100 and the image recording member 200 (PETG sheet) to which an image is transferred are superposed to form a laminated body. Before heating and pressurizing, image forming material (toner) 130 exists on the image receiving layer 120 of the transfer sheet, or a boundary between the image receiving layer 120 and the image recording member 200.

On the other hand, as shown in FIG. 2B, the image forming material 130 is entirely buried in the surface of the image recording member 200 after heating, pressurization and removing of the transfer member. There is little difference in height between the surface of the image recording member 200 and the area where the image forming material 130 exists. Therefore, the produced member having an image thereon has the same touch as a member on which an image has been printed. Furthermore, the image forming material 130 is stable and not easily removed.

The removed image-containing member can be used as an image-containing member of the invention as it is. When plural images have been formed on the transfer member, the member having images can be cut by each image to provide plural image-containing members each having a predetermined size.

(Apparatus for Producing Member Having Image Recorded Thereon)

Hereinafter, apparatus for producing a member having an image recorded thereon of the invention (an image-containing member) is explained.

The apparatus of the invention for producing a member having an image recorded thereon utilizes the transfer member of the invention, and the apparatus employs the method of producing a member having an image recorded thereon. The apparatus comprises: a transfer member housing unit for housing a transfer member of an image forming material for electrophotography, the transfer member comprising an image receiving layer disposed on at least one surface thereof; an image forming unit for forming an image as a mirror image, with an image forming material by electrophotographic means, on the image receiving layer of the transfer member; an image recording member housing unit for housing an image recording member; a positioning unit for placing the transfer member on the image recording member so that the surface, of the transfer member, at which the image has been formed faces toward at least one surface of the image recording member; a heating and pressurizing unit for adhering the transfer member to the image recording member by heat and pressure; and a removing unit for removing the transfer member from the image recording member after the image forming material has been cooled, whereby the image forming material is transferred to the image recording member to record the image.

The apparatus may comprise a conveyer pathway for providing the transfer member from the image forming unit to the positioning unit, and the conveyer pathway may have reversing means for selectively turning over the transfer member on the conveyer pathway.

The image forming unit and the positioning unit may be each independently provided, and the reversing means may be provided integrally on one of the image forming unit and the positioning unit.

Figure 3:
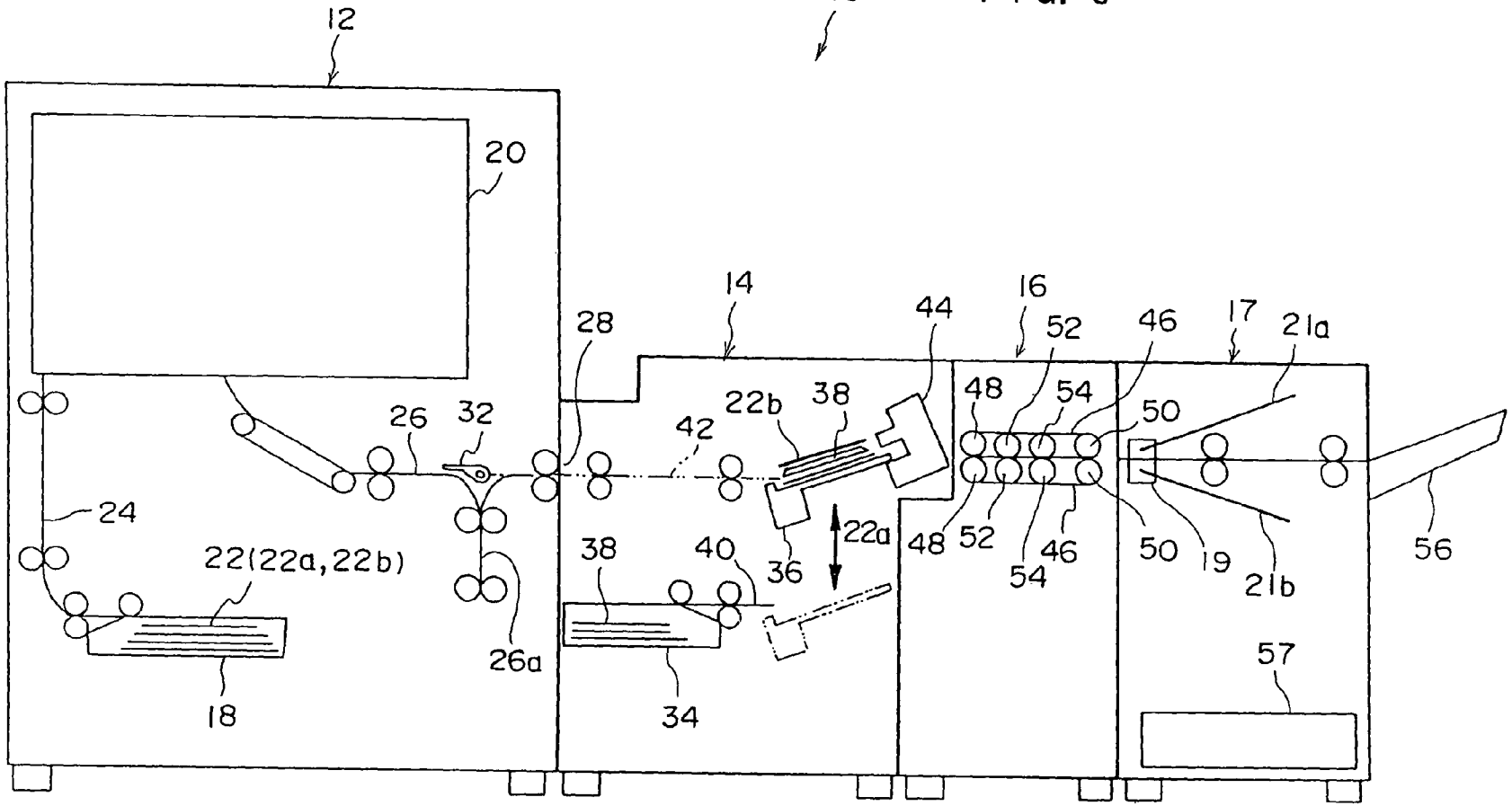
FIG. 3 is a schematic view illustrating an example of an apparatus for producing a member having an image recorded thereon of the invention.

FIG. 3 is a schematic view that shows an apparatus for producing a member having an image recorded thereon of the invention (an image-containing member).

The apparatus 10 for producing an image-containing member shown in FIG. 3 comprises image forming device 12, collating device 14 (positioning unit), laminate device 16 (heating and pressurizing unit) and removing device 17 (removing unit).

The image forming device 12 comprises, for example, transfer sheet stacker 18 (housing unit for housing a transfer member of an image forming material for electrophotography), image forming unit 20, conveyer pathway 24 for conveying transfer sheet 22 from the transfer sheet stacker 18 to the image forming unit and conveyer pathway 26 for conveying transfer sheet 22 (transfer member of image forming material for electrophotography) from image forming unit 20 to discharging port 28. Other constituents are omitted herein.

The transfer sheet stacker 18 houses the transfer sheet 22 and comprises a pick up roll and a paper feeding roll, which are provided to a conventional paper feeding device. The paper feeding roll or the like revolve at a predetermined timing to convey the transfer sheet 22 to the image forming unit 20.

The image forming unit 20 is structured as known electrophotographic apparatus (not shown in FIG. 3) comprising a latent image holding member for forming a latent image, a developing unit for developing the latent image to provide a toner image using a developer including at least a toner, a transferring unit for transferring the developed toner image to the transfer sheet 22, a fixing device for fixing the toner image transferred to the transfer sheet 22 by heat and pressure, and the like.

The conveyer pathways 24 and 26 are constituted of plural pairs of roller including a pair of driving roller and a guide (not shown), and the conveyer pathway 26 further comprises reverse pathway 26*a* for reversing the conveying direction of the transfer sheet 22 by 180 degrees. Cam 32 for changing the guide direction of the transfer sheet 22 is provided in the vicinity of the branch of the conveyer pathway 26 and the reverse pathway 26*a*. When the transfer sheet 22 is reciprocated in the reverse pathway 26*a* and returned to the conveyer pathway 26 again, the conveying direction of the transfer sheet 22 is reversed by 180 degrees, and the transfer sheet 22 is turned over and the sheet is conveyed.

The collating device 14 comprises plastic sheet stacker (image recording member housing unit) 34, collating tray (positioning unit) 36, conveyer pathway 40 for feeding plastic sheet (image recording member) 38 from the plastic sheet stacker 34 to the collating tray 36, conveyer pathway 42 for feeding the transfer sheet 22 ejected from the discharging port 28 of the image forming device 12 to the collating tray 36.

The ejection part of the conveyer pathway 40 for feeding the plastic sheet 38 to the collating tray 36 and the ejection part of the conveyer pathway 42 for feeding the transfer sheet 22 to the collating tray 36 are provided in parallel in the vertical direction.

The conveyer pathway 40 and 42 may have a structure comprising a smooth plate-shaped element and a conveying roll for conveying the transfer sheet 22 on the surface of the element, or may have a structure comprising a revolving belt-shaped conveying member. The conveying roll and belt revolve to convey the transfer sheet 22 or the plastic sheet 38 to the collating tray 36 at the timing where the transfer sheet 22 is ejected from the image forming device 12, or at the timing where the plastic sheet 38 is ejected therefrom.

The plastic sheet stacker 34 (an image recording member housing unit) comprises plastic sheet 38 and a pick up roll and a paper feeding roll, which are contained in a conventional paper feeding device, and the paper feeding roll or the like revolve at the timing immediately after the collating tray 36 moves to the position of the discharging port of the plastic sheet stacker 34 to convey the plastic sheet 38 to the collating tray 36.

A part of the end portion of the collating tray 36 is connected to the belt outer wall tensioned upward and downward (upward and downward in the drawing) so that the end portion can be elevated according to the revolution driving of the belt, in order to feed the plastic sheet 38 and the transfer sheet 22 from the ejection part of conveyer pathway 40 and the ejection part of conveyer pathway 42, respectively. The elevation means is not limited to such means and any known elevation means such as motor driving method can be applied. Furthermore, the positioning means (not shown) for aligning the laminated plastic sheet 38 and the end portion of the transfer sheet 22 is provided.

The collating tray 36 comprises temporary binding device 44 for temporarily binding a laminated body including the two transfer sheets 22 laminated via plastic sheet 38. The temporary binding device comprises a pair of projected piece made of a metal so that they are heated by a heater or the like. The heated pair of projected piece clips the vicinity of the end portion of the laminated body, whereby the vicinity of the end portion of the laminated body is adhered by heat-melt to complete temporary binding.

The method for binding temporarily is not limited to the method using a pair of projected piece as far as heat melt adhesion is used, and melt adhesion can be carried out by a conventional other method, i.e., a method for penetrating a heated needle-shaped element to sheets in vertical direction, or a method for clipping sheets with an element comprising an ultrasonic wave transducer and melt-adhering the sheets by heat generated by ultrasonic oscillation. Alternatively, fixing by means for mechanically binding the movement of the sheets without heat, i.e., fixing using a strip of a stapler or the like can be used. Alternatively, a gripper movable according to the sheets along a gripper conveying pathway can be provided.

When the temporary binding device 44 is provided on the conveyer pathway of the laminated body from the collating tray 36 to the laminate device 16, it is required that the binding device 44 has a structure that the binding device 44 is provided on the end portion of the collating tray 36 only where temporary binding is carried out and otherwise it can escape from the conveyer pathway.

For the laminate device 16, a belt nip system comprising a pair of belt 46 can be adapted. Each belt 46 is tensioned by heating and pressurizing roll 48 and tension roll 50.

The method for adhesion by pressure for the laminate device 16 is not specifically limited, and any of conventionally known various lamination methods and lamination devices can be preferably used. For example, the adhesion can be carried out by a conventional lamination method for hot melt adhering by penetrating the laminated body to a nip portion by a pair of heat roll to heat-adhere the sheets by heat in the laminated body to the same extent and a lamination device, or by using hot pressing method and a hot pressing device.

Removing device 17 comprises, for example, air blow nozzle 19 and guides 21*a* and 21*b*. Ejection tray 56 is provided on the downstream side of the conveying pathway of the plastic sheet.

Firstly, in the image forming device 12, the first transfer sheet 22*a* to be adhered to the rear surface (lower side in the drawing) of the plastic sheet 38 among the transfer sheets 22 is fed to the image forming unit 20 from the transfer sheet stacker 18 via the conveyer pathway 24, and a predetermined toner image is transferred to the upper surface (upper side in the drawing) of the first transfer sheet 22*a* by electrophotography and fixed to form a fixed image (a step for image forming). During this step, since the fixing image has been formed on the upper surface of the first transfer sheet 22*a*, the first transfer sheet 22*a* is directly conveyed to the discharging port 28 via the conveyer pathway 26, and fed to the collating device 14.

At the collating device 14, the first transfer sheet 22*a* is then supplied to the collating tray 36 via a conveyer pathway 42 of the collating device 14. The first transfer sheet 22*a* ejected from the ejection part of the conveyer pathway 42, and the image surface of the first transfer sheet 22*a* is supplied to the collating tray 36 by its own weight so that it faces upward.

The collating tray 36 is elevated to the vicinity of the ejection part of conveyer pathway 40, and the plastic sheet 38 is fed to the collating tray 36 from the plastic sheet stacker 34 to the conveyer pathway 40. The plastic sheet 38 ejected from the ejection part of the conveyer pathway 40 is supplied to the collating tray 36 by its own weight, and is superposed to the first transfer sheet 22*a*.

In the image forming device 12, the second transfer sheet 22*b* to be adhered to the surface of the plastic sheet 38 (upper side in the drawing) is fed to the image forming unit 20 from the transfer sheet stacker 18 to the conveyer pathway 24, and a predetermined toner image is transferred to the upper surface (upper side in the drawing) of the second transfer sheet 22*b* by electrophotography and fixed to form a fixed image (a step for image forming). Since the fixing image has been formed on the upper surface of the second transfer sheet 22*b*, the second transfer sheet 22*b* passes through the conveyer pathway 26 and goes once the reverse pathway 26*a* and returns to the conveyer pathway 26, and is conveyed to the discharging port 28 and feed to the collating device 14.

During this step, in the branch portion of conveyer pathway 26 and reverse pathway 26*a*, cam 32 is driven so that its tip is superposed to conveyer pathway 26, and the conveying direction of the second transfer sheet 22 once reached to the tip position of cam 32 is changed and the sheet is guided and conveyed to the reverse pathway 26*a*. After the second transfer sheet 22*b* reaches the reverse pathway 26*a*, the driving roll (not shown) is reversed, and the second transfer sheet 22*b* is moved by reciprocation on the reverse pathway 26*a* and returned again to the conveyer pathway towards the collating device 14. Accordingly, the conveying direction of the second transfer sheet 22*b* returned to the conveyer pathway 26 is reversed by 180 degree and also turned over, whereby the image surface faces downward during conveyed (downward in the drawing).

In the collating device 14, the second transfer sheet 22*b* is fed to the collating tray 36 via the conveyer pathway 42 of the collating device 14. The second transfer sheet 22*b* ejected from the ejection part of the conveyer pathway 42 is supplied to the collating tray 36 by its own weight so that the image surface of the second transfer sheet 22*b* faces downward, and is superposed on the plastic sheet 38.

Accordingly, on the collating tray 36 are fed the first transfer sheet 22*a* with the image surface facing upward, the plastic sheet 38 and the second transfer sheet 22*b* with the image surface facing downward in this order and superposed (positioning step). The laminated body comprises first transfer sheet 22*a*, plastic sheet 38 and second transfer sheet 22*b*, the image surfaces of the first transfer sheet 22*a* and the second transfer sheet 22*b* facing each other via a plastic sheet 38.

The end portions of the first transfer sheet 22*a*, the plastic sheet 38 and the second transfer sheet 22*b* on the collating tray 36 are aligned by positioning means (not shown), and the end portions of the laminated body are subjected to temporary binding by the temporary binding device 44, and the laminated body is conveyed to the laminate device 16. The sizes of the transfer sheet 22 and the plastic sheet 38 are the same, and positioning is carried out by aligning the end portions of the laminated body.

In the laminate device 16, the laminated body comprising the first transfer sheet 22*a*, the plastic sheet 38 and the second transfer sheet 22*b* is then passed between a pair of belt 46 nip and adhered with heat and pressure, and the plastic sheet 38 is adhered to the first transfer sheet 22*a* and the second transfer sheet 22*b* (step for heating and pressurizing) by heat and pressure.

The heated and pressurized laminated body is then conveyed to the removing device 17. The plastic sheet 38 has, for example, a notch in its tip right end portion, and the first transfer sheet 22*a* and the second transfer sheet 22*b* are placed to face each other at a constant distance without adhering to the plastic sheet 38 at the notch portion. When the tip end portion of the laminated body comes to air blow nozzle 19, the nozzle blows compressed air. The end portions of the first transfer sheet 22*a* and the second transfer sheet 22*b* are raised from the plastic sheet 38, and the tips of the guides 21*a* and 21*b* enter into between the first transfer sheet 22*a* and the plastic sheet 38 and between the second transfer sheet 22*b* and the plastic sheet 38, respectively. Furthermore, as the laminated body is conveyed, the two transfer sheets are conveyed to the direction apart from the plastic sheet 38 along the guides 21*a* and 21*b* and removed from the plastic sheet 38.

The plastic sheet 38 is ejected on the ejection tray 56 to provide a recorded plastic sheet. When plural images are formed on the plastic sheet, the sheet is cut by each image to provide plastic sheets each having a predetermined size.

The first transfer sheet 22*a* and the second transfer sheet 22*b* are passed through a pathway (not shown) and ejected on transfer sheet ejection tray 57. The ejected transfer sheet may be returned to the transfer sheet stacker and an image may be recorded thereonto again.

As explained above, according to the apparatus of the invention for producing a member having an image recorded thereon, an image having high resolution can be printed on the plastic sheet with high productivity using conventional electrophotographic apparatus as image forming means without great modification, by a method for forming an image by electrophotography on one surface of two transfer sheets 22, facing the image surfaces of the two transfer sheets 22 sandwiching the plastic sheet 38, adhering the sheets by heat and pressure the transfer sheet, and removing the transfer sheets.

Moreover, the transfer sheets 22 are selectively reversed by providing, in the image forming device 12, the reverse pathway 26*a* on the way of the conveyer pathway 26 conveying the transfer sheets 22 from the image forming unit 20 to the discharging port 28. Among transfer sheets 22, first transfer sheet 22*a* supplied to the bottom in the collating tray 36 is not conveyed via reverse pathway 26*a*, whereas second transfer sheet 22*b* supplied to the top in the collating tray 36 is conveyed through the reverse pathway 26*a* and reversed. Accordingly, continuous positioning can be carried out, and more efficient printing on a plastic sheet becomes possible.

EXAMPLES

Hereinafter the present invention is more specifically explained by referring to the following Examples. However, the Examples should not be construed to limit the scope of the invention. The "part" used in the following Examples and Comparative Examples means "part by mass".

Example 1

An image forming material transfer sheet for electrophotography (transfer sheet 1) is produced as follows. Hereinafter the method for producing thereof is explained by every step.

(Preparation of an Image Receiving Layer Coating Solution 1)

A silicone hard coating agent containing an organic silane condensate, a melamine resin and an alkyd resin (trade name: SHC900, manufactured by GE Toshiba Silicones, solid content 30% by mass, 10 parts), polydimethylsiloxane microparticles (trade name: TP145, manufactured by GE Toshiba Silicones, volume average particle diameter: 4.5 μm, 0.002 parts) as a filler and Pionine B/44V (trade name, manufactured by Takemoto Oil & Fat Co., Ltd., 0.2 parts) as an antistatic agent are added to a mixed solution of cyclohexanone and methylethylketone (mass ratio of 10:90, 30 parts) and thoroughly mixed to produce an image receiving layer coating solution 1.

(Preparation of an Image Forming Material Transfer Sheet for Electrophotography)

The image receiving layer coating solution 1 is applied to one surface of a substrate of a PET film (trade name: Lumirror 100T60, manufactured by Toray Industries, Inc., thickness: 100 μm), by a wire bar and dried at 120° C. for 30 seconds to form an image receiving layer having a thickness of 1 μm. Furthermore, the image receiving layer coating solution 1 is similarly applied to the other surface of the substrate (untreated surface) using a wire bar and dried at 120° C. for 30 seconds to form an image receiving layer film having a thickness of 1 μm. The substrate is cut in A4 size (210 mm×297 mm) to provide transfer sheet 1. The surface resistivity of the image receiving layer is $5.4\times10^{11}\Omega/\square$ for both surfaces.

(Evaluation of Performance of a Transfer Sheet)

A color mirror image comprising a facial portrait, a name and a solid image is formed on the image receiving layer surface on the transfer sheet 1 (image is not formed yet) using an image forming device (color copying machine, trade name: DocuColor 1255CP, manufactured by Fuji Xerox Co., Ltd.).

During the image formation, the traveling property during conveyance of the transfer sheet 1 in the image forming device is evaluated as follows.

—Evaluation of Traveling Property—

The traveling property of the thus-produced transfer sheet 1 in a color copying machine is evaluated by setting 30 sheets of the transfer sheet 1 on a manual paper feed tray of the color copying machine DocuColor 1255CP and counting the occurrences of jamming and multifeeding during sequential printing of the 30 sheets. The evaluation criteria is represented by ○ (occurrence zero), by Δ (one occurrence), or by X (two or more occurrences).

The results are shown in Table 1.

(Preparation of a Member Having an Image Recorded Thereon (Card 1))

A member having an image recorded thereon (an image-containing member) is produced as follows. An A4 size white sheet having both surfaces made of PETG and a core made of A-PET (manufactured by Mitsubishi Plastics, Inc., Dia Claire W2012, thickness: 600 μm) is used as an image recording member. Two sheets of the above-described transfer sheet 1 are placed on the both sides of the image recording member, with the image surface of the transfer sheet facing toward the image recording member. The superposed sheets are adhered using a laminator (trade name: Lamipacker LPD3206 City, manufactured by Fujipla, Inc.) under the condition of 160° C. and conveying velocity of 0.3 m/min (5 mm/s). After allowed to cool to the ordinary temperature, two sheets of the transfer sheet 1 are removed from the white sheet to produce card 1 (a member having an image recorded thereon), which is a white sheet having an image comprising a facial portrait transferred thereon. The transferred toner is entirely buried in the surface of the card 1, and little projection is observed at the image portion.

(Evaluation of the Member Having the Image Recorded Thereon)

The card 1 is evaluated as follows.

—Evaluation of Fixing Property of Image—

The fixing property of the toner image is evaluated by removing the image recorded thereon. A commercially available cellophane adhesive tape (manufactured by Nichiban Co., Ltd., cellophane tape, width 18 mm) is adhered on the image portion transferred to the surface of the card 1 at the line pressure of 700 g/cm and then peeled at the velocity of 10 mm/sec.

The result is evaluated as ◎ when no problem occurs, and as x when the image is removed or disordered. The results are shown in Table 1.

—Evaluation of Image Density and Image Quality—

The image density is measured by measuring a solid image portion using X-Rite 967 densitometer (trade name, manufactured by X-Rite, Inc.), and an image density of 1.5 or more is evaluated as ○, an image density of 1.3 or more and less than 1.5 is evaluated as Δ, and an image density of less than 1.3 is evaluated as X.

With regard to the quality of the image, precise printing transfer property (printing reproducibility) is evaluated during preparation of card 1 using the transfer sheet 1 on which an image has been output under the condition of high temperature and high humidity (28° C., 80% RH, condition A), room temperature (22° C., 50% RH, condition B) or low temperature and low humidity condition (15° C./5% RH, condition C). The quality is evaluated as ○ when no problem is observed in every condition. When a problem is observed in any one of conditions A, B and C, the quality is evaluated as X.

The results are shown in Table 1.

Comparative Example 1

The preparation and evaluation are carried out in the same manner as in Example 1, except that a commercially available PET sheet (trade name: T60, manufactured by Toray Industries, Inc., thickness: 100 μm, surface resistivity: $1\times10^{17}\Omega/\square$) is used as a transfer sheet.

As a result, with regard to the traveling property, multifeeding is repeated. Furthermore, the fixed image does not have sufficient image density and image quality. Moreover, during the preparation of an image-containing member, a PET sheet adheres to a white sheet (an image recording member) and cannot be removed from the white sheet, thus cannot be used as a transfer sheet.

Comparative Example 2

The preparation and evaluation are carried out in the same manner as in Example 1, except that a commercially available color OHP film sheet (trade name: V556, manufactured by Fuji Xerox Co., Ltd., thickness: 100 μm, surface resistivity: $5\times10^{11}\Omega/\square$) is used as a transfer sheet. The OHP film sheet has an image receiving layer on the surface thereof; however, the image receiving layer does not comprise a releasing material.

As a result, the traveling property has no problem. However, the OHP film sheet adheres to the white sheet (image recording member) during the preparation of the image-containing member and becomes difficult to be removed from the white sheet. When the sheet is removed therefrom with strong force, the image is not transferred finely, which results in an image recording member having poor image quality.

Example 2

Preparation of Image Receiving Layer Coating Solution 2

A silicone hard coating agent comprising an organic silane condensate, a melamine resin and an alkyd resin (trade name: SI coat 801, manufactured by GE Toshiba Silicones, solid content: 30% by mass, 10 parts), polydimethylsiloxane microparticles (trade name: TP130, manufactured by GE Toshiba Silicones, volume average particle diameter: 3 μm, 0.03 parts) as a filler and Elegan 264 WAX (trade name, manufactured by NOF Corporation, 0.25 parts) as an antistatic agent are added to a mixed solution of cyclohexanone and methylethylketone (mass ratio 10:90, 30 parts) and thoroughly stirred to produce image receiving layer coating solution 2.

(Preparation of an Image Forming Material Transfer Sheet for Electrophotography (Transfer Sheet 2))

The image receiving layer coating solution 2 is applied to one surface of a substrate of a PET film (trade name: Lumirror 100T60, manufactured by Toray Industries, Inc., thickness: 100 μm), using a wire bar and dried at 120° C. for 5 min to form an image receiving layer having a thickness of 0.5 μm. Furthermore, image receiving layer coating solution 2 is similarly applied to the other surface of the substrate (untreated surface) using a wire bar and dried at 120° C. for 5 min to form an image receiving layer film having a thickness of 0.5 μm. The substrate is cut in A4 size (210 mm×297 mm) to provide transfer sheet 2. The surface resistivity of this image receiving layer is $1.1\times10^{11}\Omega/\square$ for both surfaces.

(Evaluation of the Performance of a Transfer Sheet)

A color mirror image comprising a facial portrait, a name and a solid image is formed on the image receiving layer surface on the transfer sheet 2 (an image is not formed) in the same manner as in Example 1 using an image forming device (color copying machine, trade name: DocuColor 1255CP, manufactured by Fuji Xerox Co., Ltd.).

As shown in Table 1, during image formation, the traveling property during conveyance of the transfer sheet 2 in an image forming device is evaluated to have no problem.

(Preparation of an Image Recording Member (Card 2))

A member having an image recorded thereon (an image-containing member, Card 2) is produced as follows. An A4 size white sheet constituted of PETG (manufactured by Mitsubishi Plastics Inc., DIAFIX, thickness: 600 μm) is used as an image recording member. Two sheets of the transfer sheet 2 on which an image has been fixed are placed on the both sides of the image recording member, with the image surface of the transfer sheet facing toward the image recording member. The superposed sheets are adhered using a laminator (trade name: Lamipacker LPD3206 City, manufactured by Fujipla, Inc.) under the condition of 170° C. and conveying velocity of 0.3 m/min (5 mm/s). After allowed to cool to the ordinary temperature, two sheets of the transfer sheet 2 are removed from the white sheet to produce card 2 (a member having an image recorded thereon), which is a white sheet having an image comprising a facial portrait transferred thereon.

(Evaluation of the Member Having the Image Recorded Thereon)

The fixing property of image, image density and image quality of the card 2 are evaluated in the same manner as in Example 1.

The results are shown in Table 1.

Example 3

Preparation of Image Receiving Layer Coating Solution 3

A silicone hard coating material comprising an organic silane condensate, a melamine resin and an alkyd resin (trade name: SHC900, manufactured by GE Toshiba Silicones, solid content: 30% by mass, 10 parts), crosslinking-type styrene acrylic resin microparticles (trade name: MX500, manufactured by Soken Chemical & Engineering Co., Ltd., volume average particle diameter: 5 μm, 0.007 parts) as a filler, Pionine B144V (Manufactured by Takemoto Oil & Fat Co., Ltd., 0.2 parts) as an antistatic agent and a polyester resin (trade name: Foret FF-4M, manufactured by Soken Chemical & Engineering Co., Ltd., 30% by mass solution, 0.5 parts) are added to a mixed solution of cyclohexanone and methylethylketone (mass ratio 10:90, 30 parts) and thoroughly stirred to produce image receiving layer coating solution 3.

(Preparation of an Image Forming Material Transfer Sheet for Electrophotography (Transfer Sheet 3))

Image receiving layer coating solution 3 is applied to one surface of a substrate of a PET film (trade name: Lumirror 100T60, manufactured by Toray Industries, Inc., thickness: 100 μm) using a wire bar and dried at 120° C. for 5 min to form an image receiving layer having a thickness of 3 μm. Furthermore, the image receiving layer coating solution 1 used in the Example 1 is applied in the same manner to the other surface of the substrate (untreated surface) using a wire bar and dried at 120° C. for 30 seconds to form an image receiving layer having a thickness of 0.5 μm. The substrate is cut in A4 size (210 mm×297 mm) to provide transfer sheet 3. For this image receiving layer, the surface resistivity of the front surface (surface on which the image receiving layer coating solution 3 has been applied) is $2.3\times10^{11}\Omega/\square$, and the surface resistivity of the rear surface (surface on which the image receiving layer coating solution 1 has been applied) is $5.4\times10^{11}\Omega/\square$.

Card 3 (a member having an image recorded thereon) is produced using the transfer sheet 3 in the same manner as in Example 1. The performance of the transfer sheet 3 and the card 3 produced using the same are evaluated in the same manner as in Example 1.

The results are shown in Table 1.

Example 4

Preparation of an Image Forming Material Transfer Sheet for Electrophotography (Transfer Sheet 4)

Image receiving layer coating solution 4 is produced in the same manner as in Example 3, except that an urethane-modified polyester resin solution (trade name: Vylon UR1350, manufactured by Toyobo Co., Ltd., a solution in which a urethane-modified polyester is contained by 30% by mass by solid content in a solvent of methylethylketone and toluene (mass ratio 50/50), 0.5 parts) is used instead of a polyester resin to form image receiving layers each having a thickness of 0.5 μm for the front and rear surfaces to provide transfer sheet 4. In this image receiving layer, the surface resistivity of the front surface (surface on which the image receiving layer coating solution 4 has been applied) is $3.1\times10^{11}\Omega/\square$, and the surface resistivity of the rear surface (surface on which the image receiving layer coating solution 1 has been applied) is $5.4\times10^{11}\Omega/\square$.

Card 4 (a member having an image recorded thereon) is produced using the transfer sheet 4 in the same manner as in Example 1. The performance of the transfer sheet 4 and the card 4 produced using the same are evaluated in the same manner as in Example 1.

The results are shown in Table 1.

Example 5

Preparation of an Image Forming Material Transfer Sheet for Electrophotography (Transfer Sheet 5)

Image receiving layer coating solution 5 is produced in the same manner as in Example 3, except that a polyvinyl butyral resin (trade name: S-Lec BM-S, manufactured by Sekisui Chemical Co., Ltd., 3 parts) is used instead of a polyester resin, and transfer sheet 5 is produced by forming an image receiving layer having an front surface having a thickness of 2 μm and a rear surface having a thickness of 0.5 μm. For this image receiving layer, the surface resistivity of the front surface (surface on which the image receiving layer coating solution 5 has been applied) is $1.2\times10^{10}\Omega/\square$, and the surface resistivity of the rear surface (surface on which the image receiving layer coating solution 1 has been applied) is $5.4\times10^{11}\Omega/\square$.

Card 5 (a member having an image recorded thereon) is produced using the transfer sheet 5 in the same manner as in Example 1. The performances of the transfer sheet 5 and the card 5 produced using the same are evaluated in the same manner as in Example 1.

The results are shown in Table 1.

Example 6

Preparation of Image Receiving Layer Coating Solution 6

A UV curable silicone hard coating material comprising a silicone-modified acrylic resin, an acrylic resin and a photopolymerization initiator (trade name: UVHC1105, manufactured by GE Toshiba Silicones, 10 parts), polydimethylsiloxane microparticles (trade name: TP145, manufactured by GE Toshiba Silicones, volume average particle diameter 4.5 μm, 0.01 part) as a filler and Pionine B144V (manufactured by Takemoto Oil & Fat Co., Ltd., 2 parts) as an antistatic agent are added to a mixed solution of cyclohexanone and methylethylketone (mass ratio 10:90, 30 parts) to produce image receiving layer coating solution 6.

(Preparation of an Image Forming Material Transfer Sheet for Electrophotography (Transfer Sheet 6))

Image receiving layer coating solution 6 is applied to one surface of a substrate of a PET film (trade name: Lumirror 100T60, manufactured by Toray Industries, Inc., thickness 100 μm) using a wire bar and air-dried at room temperature for a while, and irradiated with ultraviolet using an ultraviolet irradiation device at the irradiation distance of about 20 cm and the irradiation strength of 160 W/cm$^2$ for 30 seconds to form an image receiving layer having a thickness of 1 μm. Furthermore, image receiving layer coating solution 2 is similarly applied to the other surface of the substrate (untreated surface) using a wire bar and dried at 120° C. for 5 minutes to form an image receiving layer film having a thickness of 1 μm. The substrate is cut in A4 size (210 mm×297 mm) to provide transfer sheet 6. For this image receiving layer, the surface resistivity of the front surface (surface on which the image receiving layer coating solution 6 has been applied) is $2.3\times10^{13}\Omega/\square$, and the surface resistivity of the rear surface (surface on which the image receiving layer coating solution 2 has been applied) is $1.1\times10^{11}\Omega/\square$.

Card 6 (a member having an image recorded thereon) is produced using the transfer sheet 6 in the same manner as in Example 1. The performance of the transfer sheet 6 and the card 6 produced using the same are evaluated in the same manner as in Example 1.

The results are shown in Table 1.

TABLE 1

| | Traveling property | Fixing property | Image density | Image quality |
|---|---|---|---|---|
| Example 1 | ○ | ◎ | ○ | ○ |
| Example 2 | ○ | ◎ | ○ | ○ |
| Example 3 | ○ | ◎ | ○ | ○ |
| Example 4 | ○ | ◎ | ○ | ○ |
| Example 5 | ○ | ◎ | ○ | ○ |
| Example 6 | ○ | ◎ | ○ | ○ |
| Comparative Example 1 | X | — | X | X |
| Comparative Example 2 | ○ | — | X | X |

As shown in Examples 1 to 6, the transfer sheet of the invention has an excellent image transfer property, since the transfer sheet comprises a releasing material (a silicone hard coating material) in the image receiving layer. On the other hand, Comparative Examples 1 and 2 do not provide an image receiving layer in a transfer sheet, which results in insufficient performance as a transfer member (sheet).

Furthermore, an image recording member produced using any of the image forming material transfer sheets of Examples 1 to 6 has excellent fixing property, image density and image quality, and has good quality as a card (information recording medium).

What is claimed is:

1. An image recording member having a toner image recorded thereon, the toner image comprising:

a toner image, formed by electrophotographic means, as a mirror image, on an image receiving layer of a toner transfer sheet for electrophotography, the toner transfer sheet comprising a substrate and the image receiving layer disposed on at least one surface of the substrate, wherein the image receiving layer comprises at least a releasing material and has a surface resistivity of $1.0\times10^{8}$ to $3.2\times10^{13}\Omega/\square$ at 23° C. and 55% RH, wherein the surface of the transfer sheet is adhered, at which the toner image has been formed, to at least one surface of the image recording member by heat and pressure, when the surface of the transfer sheet is adhered to the at least one surface to the image recording member, positioning is carried out, the transfer sheet is removed from the image recording member once the toner is transferred to and fixed on the image recording member by heat and pressure, and is cooled, so that the toner image is exposed on the surface of the image recording member, the toner is buried almost completely in the surface of the image recording member, the toner image on the image recording member is a normal, non-mirror image, and at least a surface of the image recording member, to which a toner image is transferred, comprises a polyester resin copolymerized with at least ethyleneglycol, terephthalic acid and 1,4-cyclohexanedimethanol.

2. The member of claim 1, wherein the image recording member comprises at least an information chip from which information can be at least read by using at least one means selected from a group consisting of electric means, magnetic means and optical means.

3. The member of claim 2, wherein the information chip is an IC chip.

4. The member of claim 1, wherein the image recording member is a plastic sheet.

* * * * *